US007182546B1

(12) United States Patent
Kimble

(10) Patent No.: US 7,182,546 B1
(45) Date of Patent: Feb. 27, 2007

(54) COUPLER COMPONENTS AND COUPLING SYSTEM FOR FRONT-END LOADER

(75) Inventor: Allen E. Kimble, Rock Spring, GA (US)

(73) Assignee: JRB Attachments, LLC, Cedar Rapids, IA (US)

( * ) Notice: Subject to any disclaimer, the term of this patent is extended or adjusted under 35 U.S.C. 154(b) by 186 days.

(21) Appl. No.: 10/819,677

(22) Filed: Apr. 7, 2004

Related U.S. Application Data

(60) Provisional application No. 60/487,095, filed on Jul. 14, 2003, provisional application No. 60/460,991, filed on Apr. 7, 2003.

(51) Int. Cl.
*F16D 1/00* (2006.01)
*B25G 3/18* (2006.01)
*E02F 3/96* (2006.01)

(52) U.S. Cl. ..... 403/322.3; 403/321; 403/322.1; 37/468; 414/723

(58) Field of Classification Search ..... 403/321, 403/322.1, 322.3, 322.4, 324, 408.1; 414/705, 414/723; 37/468, 903; 172/272–275
See application file for complete search history.

(56) References Cited

U.S. PATENT DOCUMENTS 3,243,066 A * 3/1966 Gardner ..... 414/698
3,760,883 A * 9/1973 Birk ..... 172/273
4,208,163 A * 6/1980 Holmqvist ..... 414/723
4,708,579 A 11/1987 Baird et al. ..... 414/723
5,088,882 A * 2/1992 Lovitt, Jr. ..... 414/723
5,310,275 A * 5/1994 Lovitt ..... 403/322.3
5,415,235 A 5/1995 Gebauer ..... 172/273
5,529,419 A 6/1996 Gebauer ..... 403/24
5,590,483 A * 1/1997 Kim ..... 37/468
5,692,850 A 12/1997 Kimble et al. ..... 403/24
5,865,594 A * 2/1999 Kim ..... 414/723
6,227,792 B1 5/2001 Baker et al. ..... 414/723
6,860,706 B2 * 3/2005 Godwin et al. ..... 414/723
6,991,398 B2 * 1/2006 Leemans et al. ..... 403/324
7,014,385 B2 * 3/2006 Lim et al. ..... 403/322.4

OTHER PUBLICATIONS

Penberton Couplers advertisement, Printed May 2004, product introduction date unknown.

* cited by examiner

*Primary Examiner*—Robert J. Sandy
*Assistant Examiner*—Ruth C. Rodriguez
(74) *Attorney, Agent, or Firm*—Fay Sharpe LLP

(57) ABSTRACT

A female coupler portion includes first and second vertical ribs arranged in a spaced-apart relationship. The ribs comprise first and second hooks and first and second ears, respectively, wherein each of the first and second ears includes at least one shoulder projecting outwardly therefrom. A male coupler portion includes a frame having a front region and a rear region that is pinned to the machine. A first pair of hook engaging mounts are adapted to be received respectively by first and second hooks of a female coupler portion; a first pair of openings are adapted to receive first and second ears of a female coupler portion; first and second lock members are movable between an unlocked position and a locked position to engage the ears of the female coupler portion. The ribs can be constructed from conventional ribs. The male coupler portion optionally includes multiple mounting locations for mating with different female coupler portions.

16 Claims, 16 Drawing Sheets

COUPLER COMPONENTS AND COUPLING SYSTEM FOR FRONT-END LOADER

CROSS-REFERENCE TO RELATED APPLICATIONS

This application claims priority from and benefit of the filing date of U.S. provisional patent application Ser. No. 60/487,095 filed Jul. 14, 2003 and U.S. provisional patent application Ser. No. 60/460,991 filed Apr. 7, 2003.

BACKGROUND OF THE INVENTION

Couplers and coupling systems for front-end loaders are well-known and widely used to provide for quick connect/disconnect of attachments, such as buckets, forks or the like, to the arms and control linkage of a front-end loader or like machine. Examples of such couplers and coupling systems are disclosed in commonly owned U.S. Pat. Nos. 4,708,579; 5,415,235; 5,529,419; and 5,692,850, all of which are hereby expressly incorporated by reference herein. It should be noted that the male coupler portion of present invention is described herein with reference to a Z-bar style tilt linkage. Those of ordinary skill in the art will recognize that the male coupler portion is equally suitable for a tool-carrier application, wherein two tilt cylinders are provided. Also, the term "front end loader" as used herein is not intended to be limiting in any way and is intended to encompass any tractor, wheel-loader backhoe or other machine having two arms to which the male coupler portion can be operatively pinned for pivoting movement together with an attachment mated therewith.

Known couplers have been deemed sub-optimal for a variety of reasons. They include locking mechanisms that reduce visibility through the central region of the coupler. The lock mechanisms of prior couplers require machining operations to ensure proper operation of the plunger-type lock mechanism, and this increases cost of manufacture. Lock mechanisms of known couplers allow an attachment to move relative to the coupler or "rattle" during operation, especially when the coupler and/or attachment are worn, and the lock mechanism does not compensate for this wear. Known couplers and coupling systems have not included a female coupling portion designed to mate with both a conventional male coupler portion and a new male coupler portion as disclosed herein. Also, known couplers are sensitive to misalignment which can make coupling operations difficult at times under real-world conditions. Known couplers using a single actuator to move one or more lock members have been found to be sensitive to misalignment because both female ribs must be aligned properly for the actuator to actuate the locking mechanism.

In light of the foregoing reasons and others, new and improved coupler components and a new and improved coupler system including same are disclosed herein.

SUMMARY

In accordance with a first aspect of the present development, a male coupler portion comprises: a frame having a front region and a rear region, said rear region comprising first and second pin-on locations for being pivotally connected to respective first and second associated machine arms, and at least one pin-on location for an associated tilt control member; a first pair of laterally spaced apart hook engaging mounts adapted to be received respectively by associated first and second hooks of an associated female coupler portion; a first pair of openings adapted to receive respective associated first and second projecting ears of the associated female coupler portion; first and second lock members slidably connected to said frame and each movable between an unlocked position and a locked position, wherein said first lock member at least partially obstructs one of said first pair of openings when moved to the locked position, and wherein said second lock member at least partially obstructs the other of said first pair of openings when moved to the locked position, each of said first and second lock members comprising first and second sections separated by a gap; and, at least one actuator connected to the frame and operably coupled to the first and second lock members for moving the first and second lock members between the unlocked and locked positions.

In accordance with another aspect of the present invention, a female coupler portion comprises first and second vertical ribs arranged in a spaced-apart relationship. Each of said ribs comprises: a hook and an ear. The ear comprises at least one shoulder projecting outwardly therefrom in a direction transverse to a vertical plane that includes both said hook and said ear.

In accordance with another aspect of the present invention, a coupling system comprises a female coupler portion that comprises first and second vertical ribs arranged in a spaced-apart relationship. The ribs comprise first and second hooks and first and second ears, respectively, wherein each of said first and second ears comprises at least one shoulder projecting outwardly therefrom. The coupling system further comprises a male coupler portion that comprises: a frame having a front region and a rear region, said rear region comprising first and second pin-on locations for being pivotally connected to respective first and second associated machine arms, and at least one pin-on location for an associated tilt control member; a first pair of laterally spaced apart hook engaging mounts adapted to be received respectively by said first and second hooks of said female coupler portion; a first pair of openings adapted to receive said first and second ears of said female coupler portion; first and second lock members slidably connected to said frame and each movable between an unlocked position and a locked position, wherein said first and lock member at least partially obstructs one of said first pair of openings and engages said at least one shoulder of said first ear when moved to the locked position, and wherein said second lock member at least partially obstructs the other of said first pair of openings and engages said at least one shoulder of said second ear when moved to the locked position; and, at least one actuator connected to the frame and operably coupled to the first and second lock members for moving the first and second lock members between the unlocked and locked positions.

In accordance with another aspect of the present invention, a rib for a female coupler comprises a hook and an ear. The ear comprises at least one shoulder projecting outwardly therefrom in a direction transverse to a vertical plane that includes both said hook and said ear.

In accordance with another aspect of the present invention, a method of constructing a rib of a female coupler comprises: providing a conventional female coupler rib that comprises a hook and an ear; and, connecting at least one shoulder to said ear so that said at least one shoulder projects outwardly from said ear.

BRIEF DESCRIPTION OF THE DRAWINGS

A coupling system provided in accordance with the present invention comprises various components and arrangements of components, and comprises various steps and arrangements of steps, preferred embodiments of which are illustrated in the accompanying drawings that form a part hereof and wherein.

DETAILED DESCRIPTION OF PREFERRED EMBODIMENTS

Figure 1:
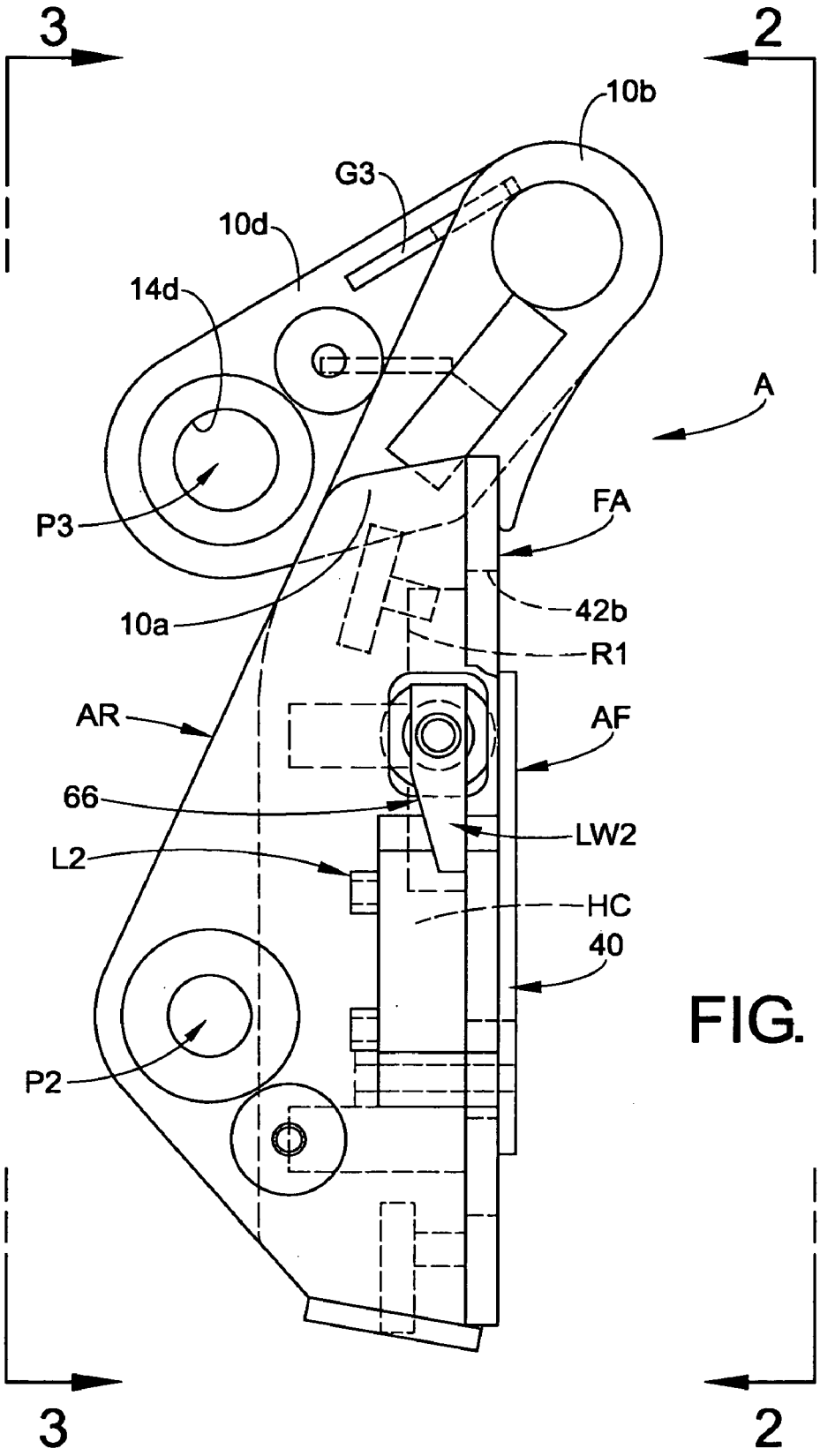
FIG. 1 is a right side elevational view of a male portion of a coupling system formed in accordance with the present invention.
Figure 2:
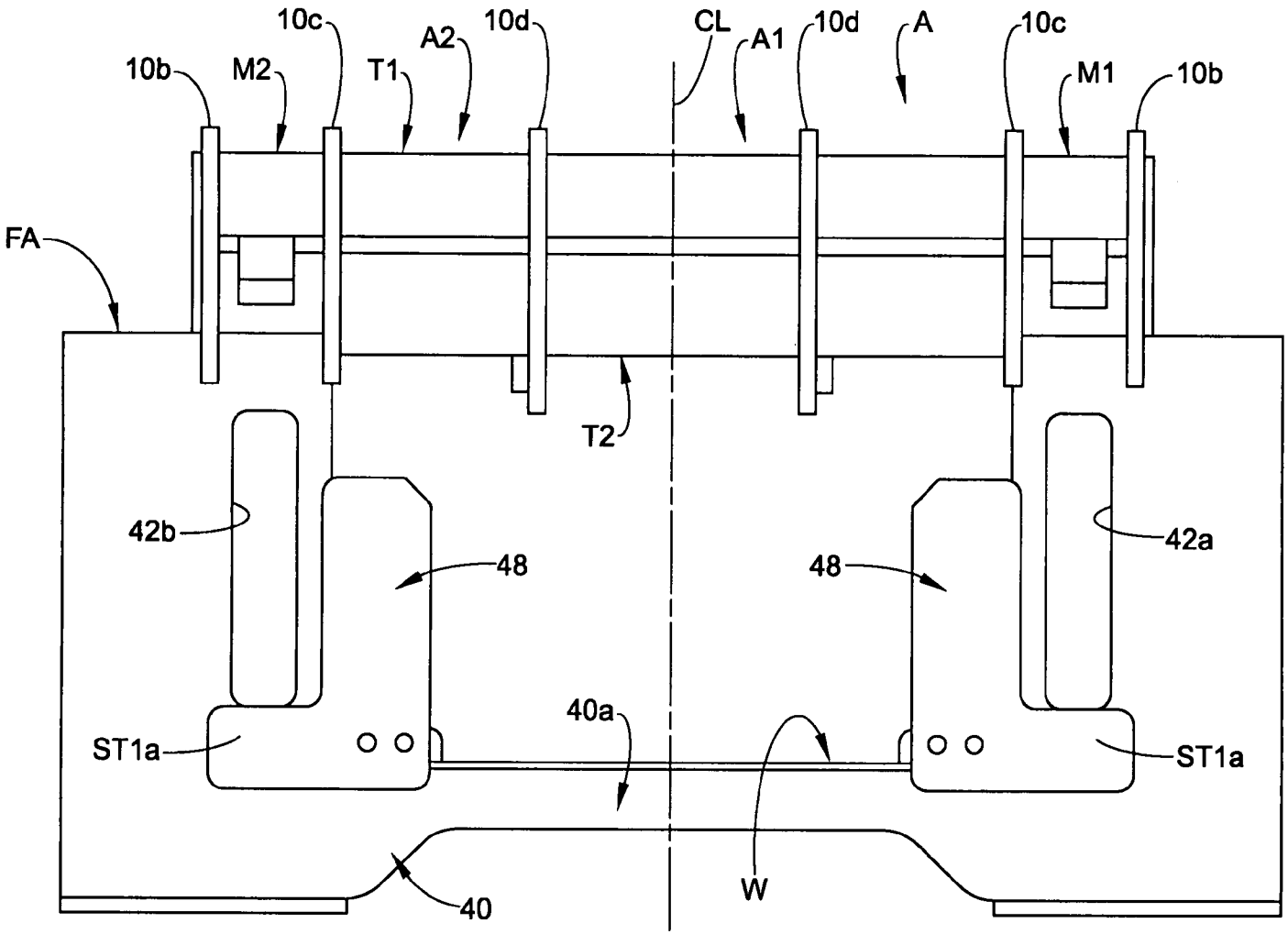
FIG. 2 is a front elevational view of the male coupler portion shown in FIG. 1 as taken along line 2—2 of FIG. 1 (the lock assemblies are not shown in FIG. 2 for clarity)
Figure 3:
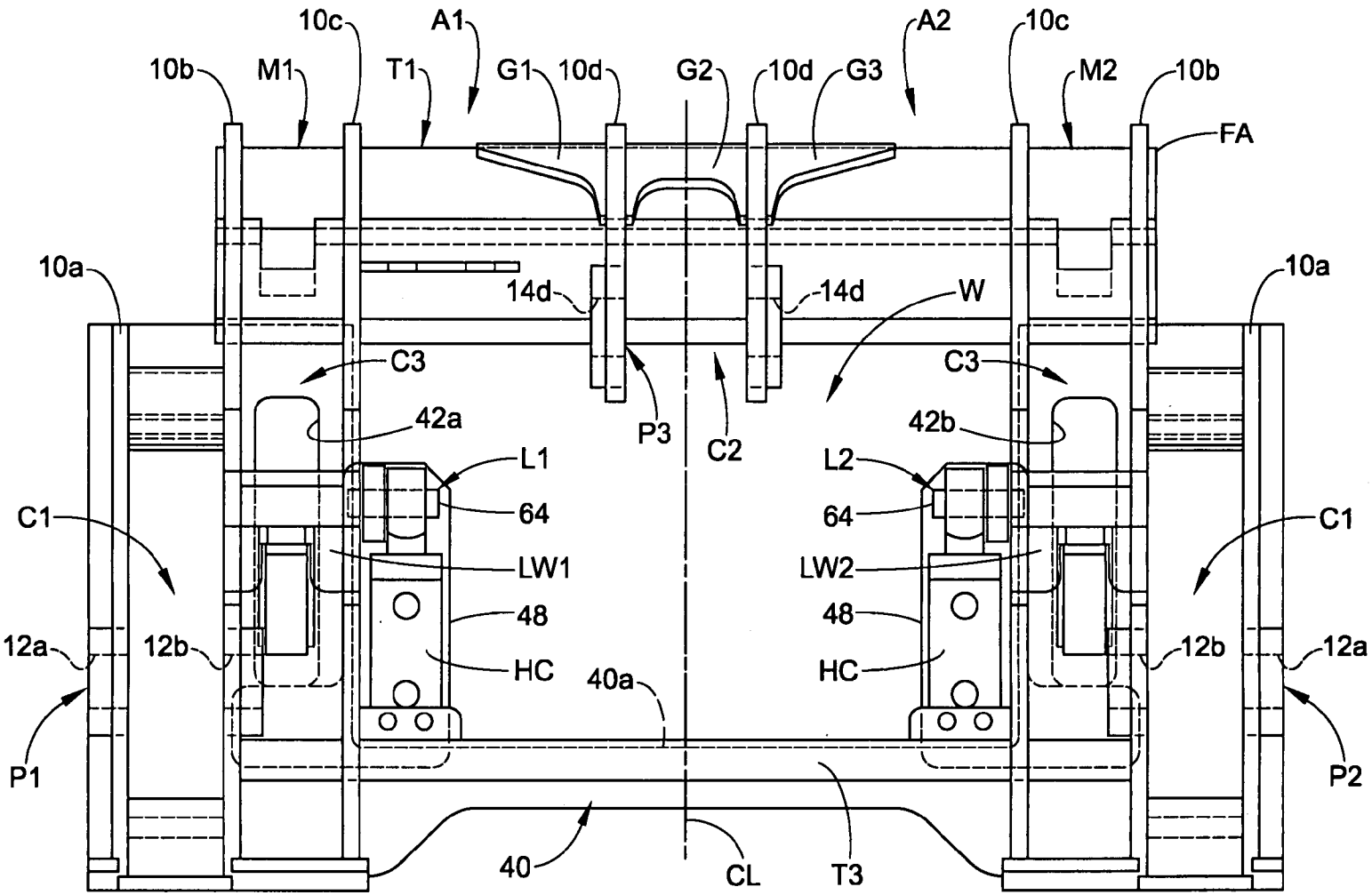
FIG. 3 is a rear elevational view of the male coupler portion shown in FIG. 1 as taken along line 3—3 of FIG. 1.

FIGS. 1–3 illustrate a male coupler portion A comprising a frame FA and first and second lock assemblies L1,L2. The male coupler portion A is defined by first and second lateral halves A1,A2 that are preferably formed symmetrically or nearly so about a centerline CL. For ease of understanding the development, the male coupler portion A is described herein as having a front region AF (FIG. 1) that is oriented toward and engages an associated female coupler portion B (described below in relation to FIG. 6B), and a rear region AR that is oriented toward and connected via pin-on connection to an associated loader machine (not shown).

The frame FA comprises a plurality of parallel, spaced-apart vertical ribs defined from steel plate or the like. In the illustrated embodiment, each half A1,A2 of the male coupler portion A comprises four parallel vertical ribs 10*a*,10*b*,10*c*, 10*d*. The ribs 10*a*,10*b* of each coupler half A1,A2 cooperate to define therebetween an arm-receiving channel C1 adapted to receive the distal end of the arm of an associated loader machine. The ribs 10*a*,10*b* define respective apertures 12*a*, 12*b* that are aligned so as to define arm pin-on point P1 for the coupler half A1 and arm pin-on point P2 for the coupler half A2. As such, the ribs 10*a*,10*b* of each coupler half A1,A2 are adapted for pin-on pivotable connection to associated arms of a front-end loader or other like machine at locations P1,P2 by means of the aligned apertures 12*a*,12*b*. This allows the male coupler portion A to pivot relative to the loader arms about the pin-on points P1,P2 between dump and roll-back positions known in the art.

Likewise, the coupler portion A comprises at least one and possibly multiple locations for pin-on connection to a tilt-link and/or first and second tilt-cylinders. As shown herein, the associated tilt link or other control member of the associated loader machine is adapted for pin-on pivotable connection to the male coupler portion A between the central ribs 10*d* of each coupler half A1,A2 at a location P3 by means of aligned apertures 14*d* defined in the central ribs 10*d*. More particularly, the two central ribs 10*d* cooperate to define therebetween a link channel C2 adapted to receive and accommodate a pin-on connection of an associated tilt link, cylinder rod-eye or other member that controls the angular position of the male coupler portion A relative to the loader arms connected at pin-on points P1,P2. The tilt link or other control member is pivotally secured to the male coupler portion A via pin-on connection at the point P3 defined by the aligned apertures 14*d* of ribs 10*d*. Bosses and pin-retainers are provided at all pin-on locations P1,P2,P3 to ensure proper pin fit and retention and for added strength as is generally known in the art.

The ribs 10*b*,10*c* of each coupler half A1,A2 define therebetween a lock channel C3. As described in further detail below, the coupler halves A1,A2 include respective lock assemblies L1,L2. The lock assemblies L1,L2 include respective locking wedges LW1,LW2. The lock wedge LW1 is slidably located at least partially in the lock channel C3 of the coupler half A1 and the lock wedge LW2 is slidably located at least partially in the lock channel C3 of the coupler half A2.

The coupler frame FA preferably comprises at least two and preferably at least three horizontal cross-members or cross-bars T1,T2,T3 arranged perpendicular to the ribs

Figure 5:
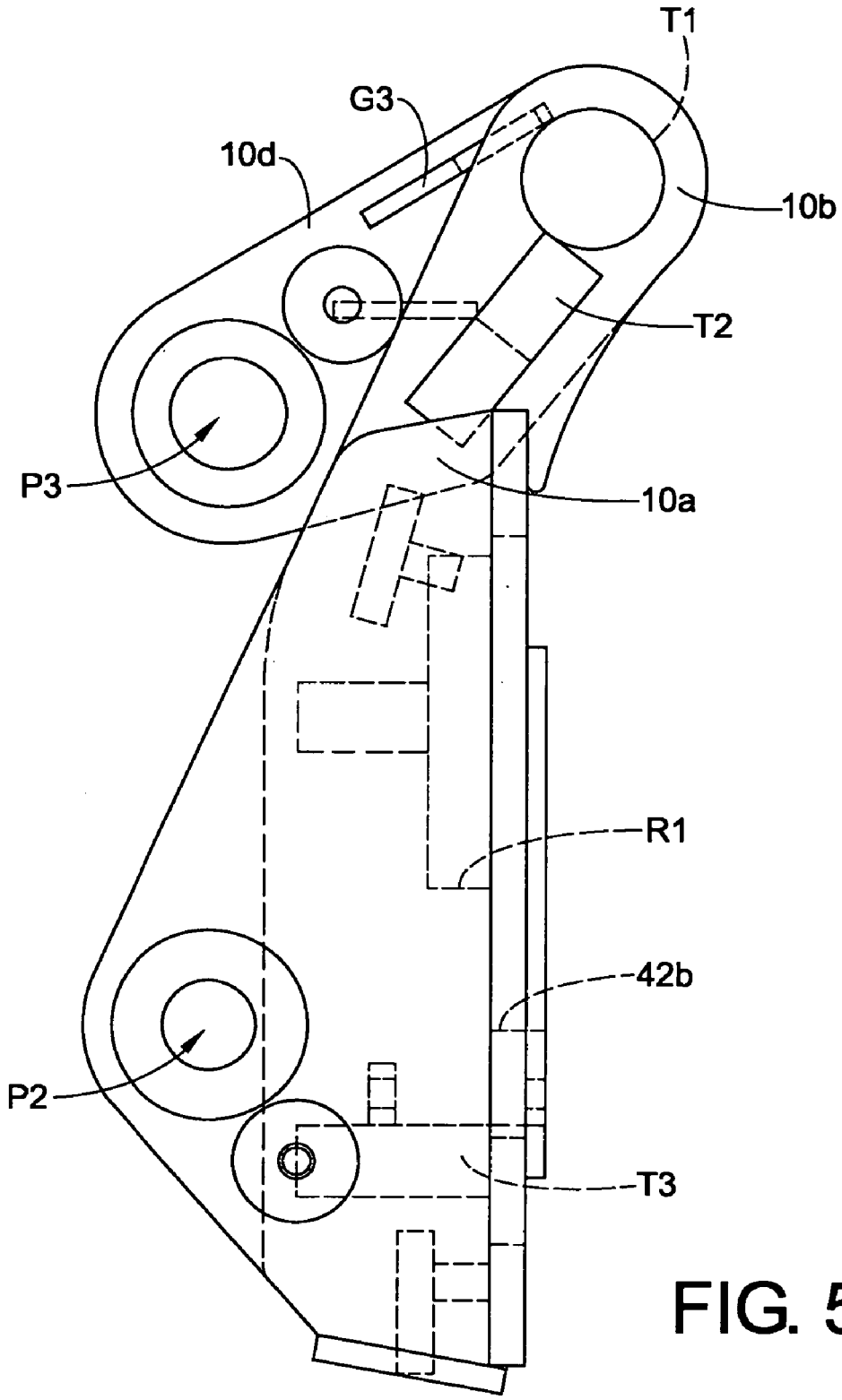
FIG. 5 is a right side elevational view of the frame shown in FIG. 4.

10*a*–10*d*. The ribs 10*b*,10*c*,10*d* of each coupler half A1,A2 are fixedly secured to a first, upper round (or other shape) steel cross-member/cross-bar T1 by insertion of the member T1 through aligned apertures defined in the ribs 10*b*,10*c*,10*d* of each half A1,A2 and welding at each juncture of the member T1 with the ribs. In a similar manner, a second cross-bar T2 is connected to the ribs 10*b*,10*c*,10*d* of each coupler half A1,A2 by passage through aligned openings in all of the ribs and welding at the various interfaces between the cross-bar T2 and each rib. The first and second cross-bars T1,T2 are located adjacent each other. A lower horizontal cross-member/cross-bar T3 is vertically spaced from the second cross-bar T2. The lower cross-bar T3 extends through openings defined in the ribs 10*c* of each half A1,A2 and is welded to these ribs 10*c* and is also welded to the ribs 10*b* of each half A1,A2. Various gussets G1,G2,G3 are provided for added strength (shown only in FIGS. 1,3,5).

Figure 6B:
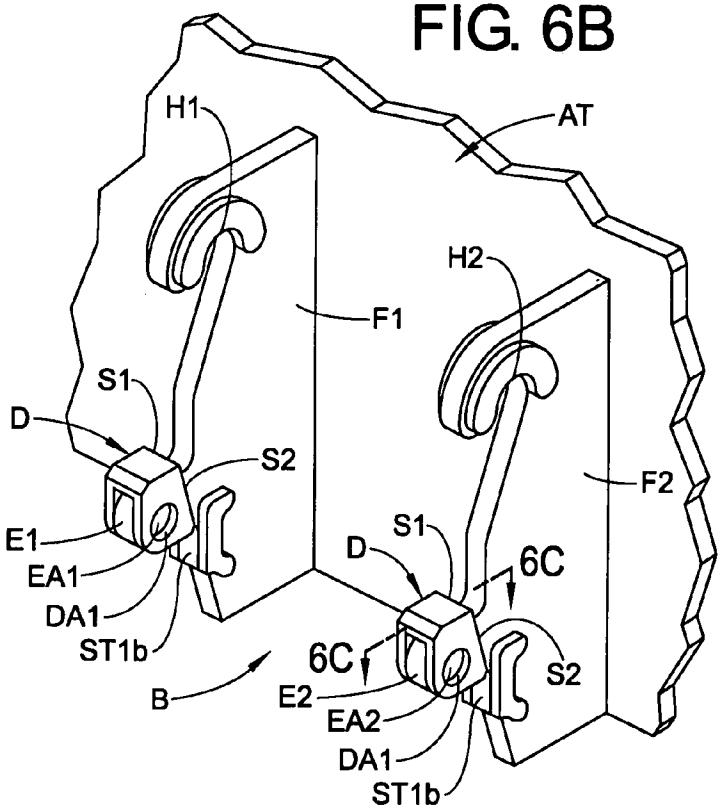
FIG. 6B is an isometric view that illustrates a female coupler portion comprising first and second female ribs connected to an associated attachment in accordance with the coupling system of the present invention.

FIG. 6B shows a female portion B of the coupling system that selectively and releasably mates with the male portion A. The female portion B comprises first and second vertical, generally parallel, spaced-apart female ribs such as ribs F1,F2 connected to a bucket or other attachment AT such as forks or the like. As such, mating of the male portion A with the female portion B results in operative connection of the attachment AT to the loader arms and control linkage of the associated loader to which the male portion A is connected via pin-on connections at points P1,P2,P3 as described above.

The ribs F1,F2 define respective hooks H1,H2 and ears E1,E2 spaced from the hooks. The ears E1,E2 define respective transverse apertures EA1,EA2 and these apertures are aligned with each other. Thus, except as noted below, the female portion B is conventional in all respects and is able to mate with known male coupler portions such as those disclosed in the above-identified patents. The female portion B is different from known female portions in that each ear E1,E2 includes or defines at least one and preferably two shoulders S1,S2 (see also FIG. 6C) that are aligned with each other and that are located between the aperture EA1, EA2 and an inner end EI of each ear E1,E1. The shoulders S1,S2 preferably extend from an upper edge EU at least halfway to, and preferably substantially to, a lower edge EL of each ear E1,E2 in a direction transverse to the direction in which the ears E1,E2 project from the rib F1,F2. As described below, these shoulders S1,S2 provide locations where the female ribs F1,F2 are engaged and captured by the lock wedge members LW1,LW2, respectively, of the male coupler portion A.

The shoulders S1,S2 can be defined by any suitable and convenient means. In one embodiment, the shoulders S1,S2 are defined as a one-piece construction with the ears E1,E2 (e.g., by machining etc.) or, alternatively, the shoulders can be defined by attachment of one or more members to the ears E1,E2. The shoulders S1,S2 project laterally out from ears E1,E2, transverse (e.g., perpendicular) to a plane that includes the ear E1,E2 and the corresponding hook H1,H2. The shoulders S1,S2 are preferably aligned with each other.

Figure 6C:
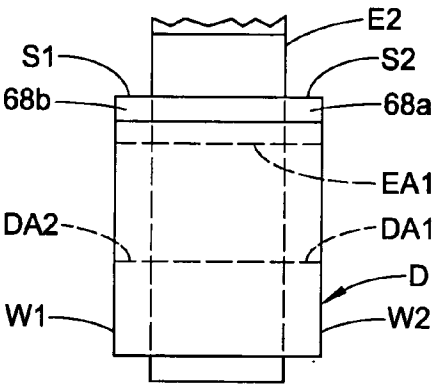
FIG. 6C is a partial top plan view of a female rib formed in accordance with the present invention as taken along line 6C—6C of FIG. 6B.
Figure 6A:
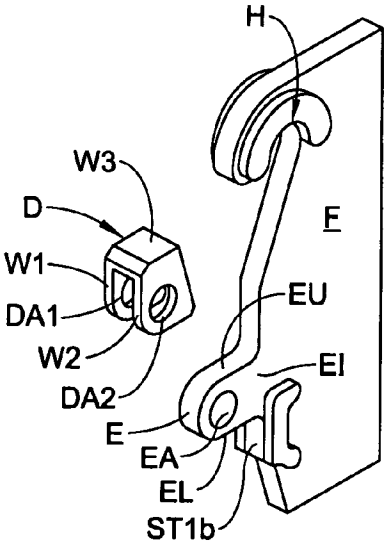
FIG. 6A is an exploded isometric view of a conventional female rib of a conventional female coupler portion and further illustrating an adapter member to be connected thereto to provide a female rib in accordance with the coupling system of the present invention.

FIG. 6A illustrates an example process for construction a female rib F1,F2 in accordance with the present invention. A conventional female rib F is provided as a starting point. The female rib F is constructed according to the above-identified U.S. Patents. In accordance with the present invention, an adapter D is closely fitted over and is welded or otherwise fixedly secured to the ear E of the conventional rib F to define a rib F1,F2. The adapter D includes first and second parallel sidewalls W1,W2 interconnected by a top wall W3. The ear E is received in a channel defined between the sidewalls W1,W2. The walls W1,W2 define aligned apertures DA1,DA2 that register with the aperture EA of the ear E. As such, when the adapter D is fitted to the ear E, the walls W1,W2 define the respective shoulders S1,S2 without blocking or interfering with the ear aperture EA.

The result is illustrated in FIG. 6C where it can be seen that the apertures DA1,DA2 of adapter D are aligned with aperture EA1 of ear E2 to allow for passage of a conventional plunger-type lock member therethrough. At the same time, the walls W1,W2 of adapter D define the respective shoulders S1,S2. As noted, this allows the female coupler portion B to mate with conventional male coupler portions (via insertion of plunger pins through the aligned apertures DA1,DA2,EA) as well as with the male coupler portion A formed in accordance with the present invention and disclosed herein.

Referring again to FIGS. 2–4, the male coupler portion A comprises a first pair of hook engaging mounts comprising first and second hook engaging mounts M1,M2 (one per half A1,A2) that engage and are received into hooks H1,H2 of respective female ribs F1,F2 that are connected to an associated bucket or other attachment AT as described above with reference to FIG. 6B. More particularly, in the illustrated embodiment, the mounts M1,M2 are defined as part of or connected to the upper cross-member T1 and are located between the ribs 10*b*,10*c* of each half A1,A2 of the male coupler portion A so as to be aligned with respective channels C3. Alternatively, the mounts M1,M2 are provided separate from the upper cross-member T1. Preferably, the mounts M1,M2 and the hooks H1,H2 define or otherwise comprise mating cylindrical surfaces so that the ribs F1,F2 pivot about the mounts M1,M2 as described further below for coupling/decoupling.

A generally U-shaped steel face plate 40, preferably but not necessarily one-piece, extends across the front AF of the coupler A. The steel face plate 40 is welded to all of the ribs 10*a*,10*b*,10*c*,10*d* of both coupler halves A1,A2. It is most preferred that, for added visibility, the plate 40 be U-shaped as shown and comprise a narrow central web region 40*a* that extends between the ribs 10*c* of each coupler half A1,A2. Thus, it can be seen that a large, open and unobstructed window W for high visibility is defined and framed by the ribs 10*c* of each half, the narrow portion 40*a* of plate 40 and the upper cross-bar T2.

The plate 40 defines openings 42*a*,42*b* (FIGS. 2 and 3) through which the ears E1,E2 of the female coupler portion B project when the male coupler portion A is mated to the female coupler portion B, i.e., when the mounts M1,M2 of male coupler portion A are seated in the hooks H1,H2 of ribs F1,F2. The opening 42*a* is aligned with the lock channel C3 of the coupler half A1, the opening 42*b* is aligned with the lock channel C3 of the coupler half A2. As such, when the female coupler portion B is operably mated with the male coupler portion A, the ear E1 projects through opening 42*a* into the lock channel C3 of coupler half A1 for engagement by the lock wedge LW1, and the ear E2 projects through opening 42*b* into lock channel C3 of coupler half A2 for engagement by the lock wedge LW2. Stops ST1*a* (FIG. 2) are located respectively adjacent openings 42*a*,42*b* to engage stops ST1*b* of ribs F1,F2. The openings 42*a*,42*b* can be provided as any open space that accommodates the ears E1,E2, respectively, and need not be configured as shown.

Figure 9B:
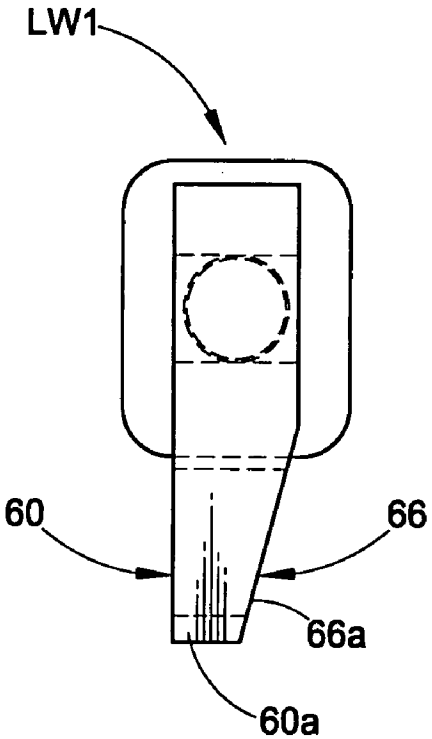
FIGS. 9A and 9B are respective front and left side views of a left side lock member formed in accordance with the present invention.
Figure 9A:
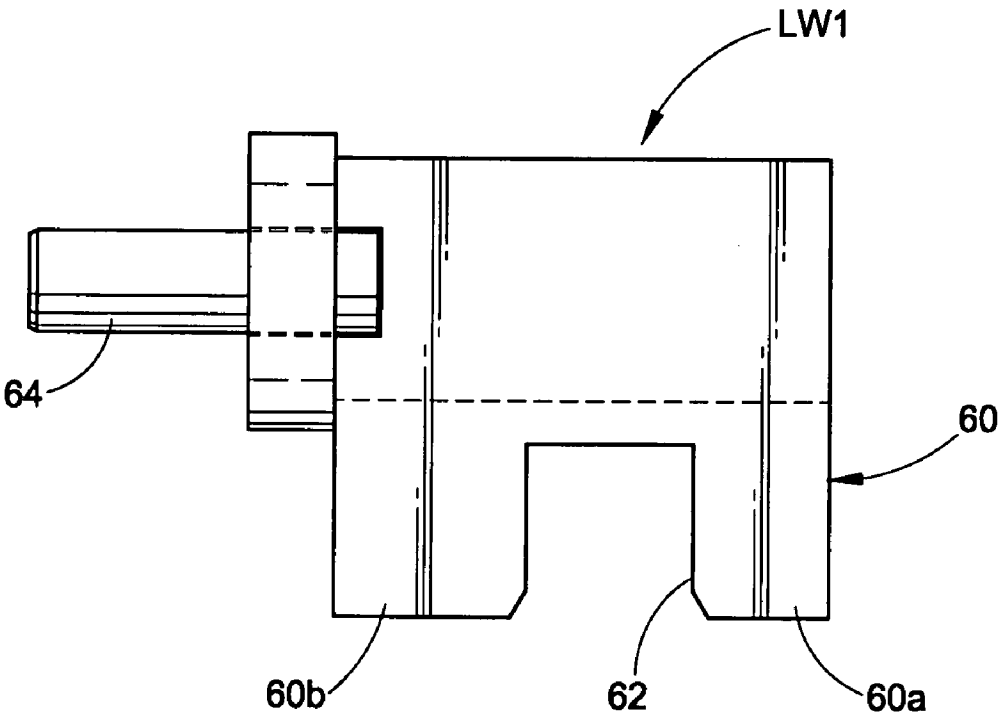
Figure 10B:
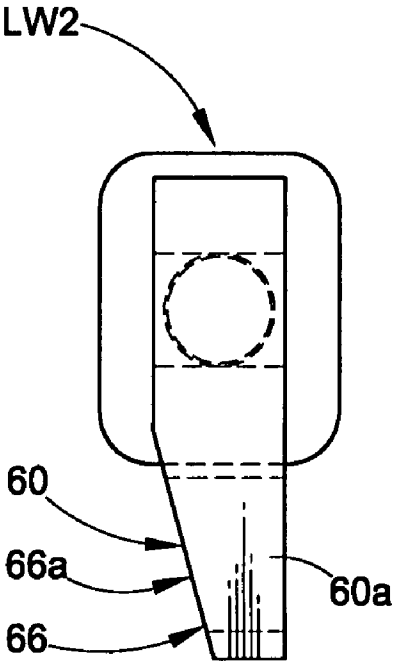
FIGS. 10A and 10B are respective rear and right side views of a right side lock member formed in accordance with the present invention.
Figure 10A:
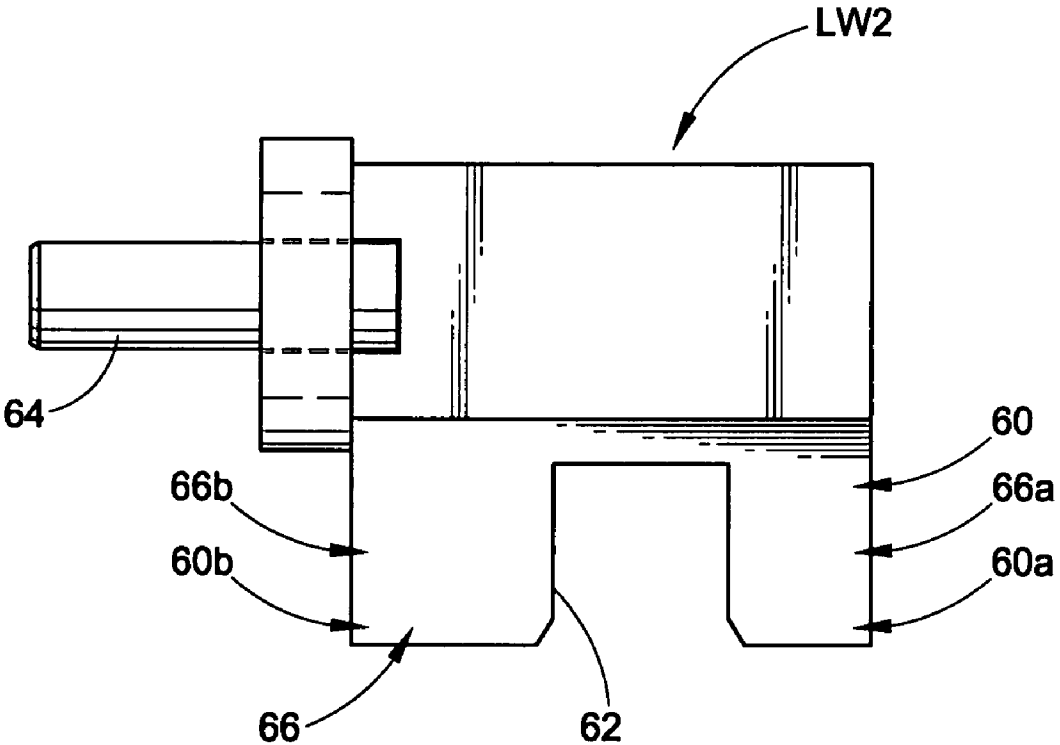

The lock wedge LW1 is shown separately in FIGS. 9A and 9B and the lock wedge LW2 is shown in FIGS. 10A and 10B. In the illustrated example, the lock wedges LW1,LW2 are mirror images of each other. The lock wedges LW1,LW2 comprises a wedge member 60 having first and second wedge portions 60*a*,60*b* separated by a gap 62. A shaft 64 projects outwardly from wedge member 60 and extends laterally inward toward centerline CL of coupler A. The wedge member 60 defines a sloped or tapered wedge face 66 comprising first and second tapered portions 66*a*,66*b* defined by the wedge portions 60*a*,60*b*, respectively.

Figure 4:
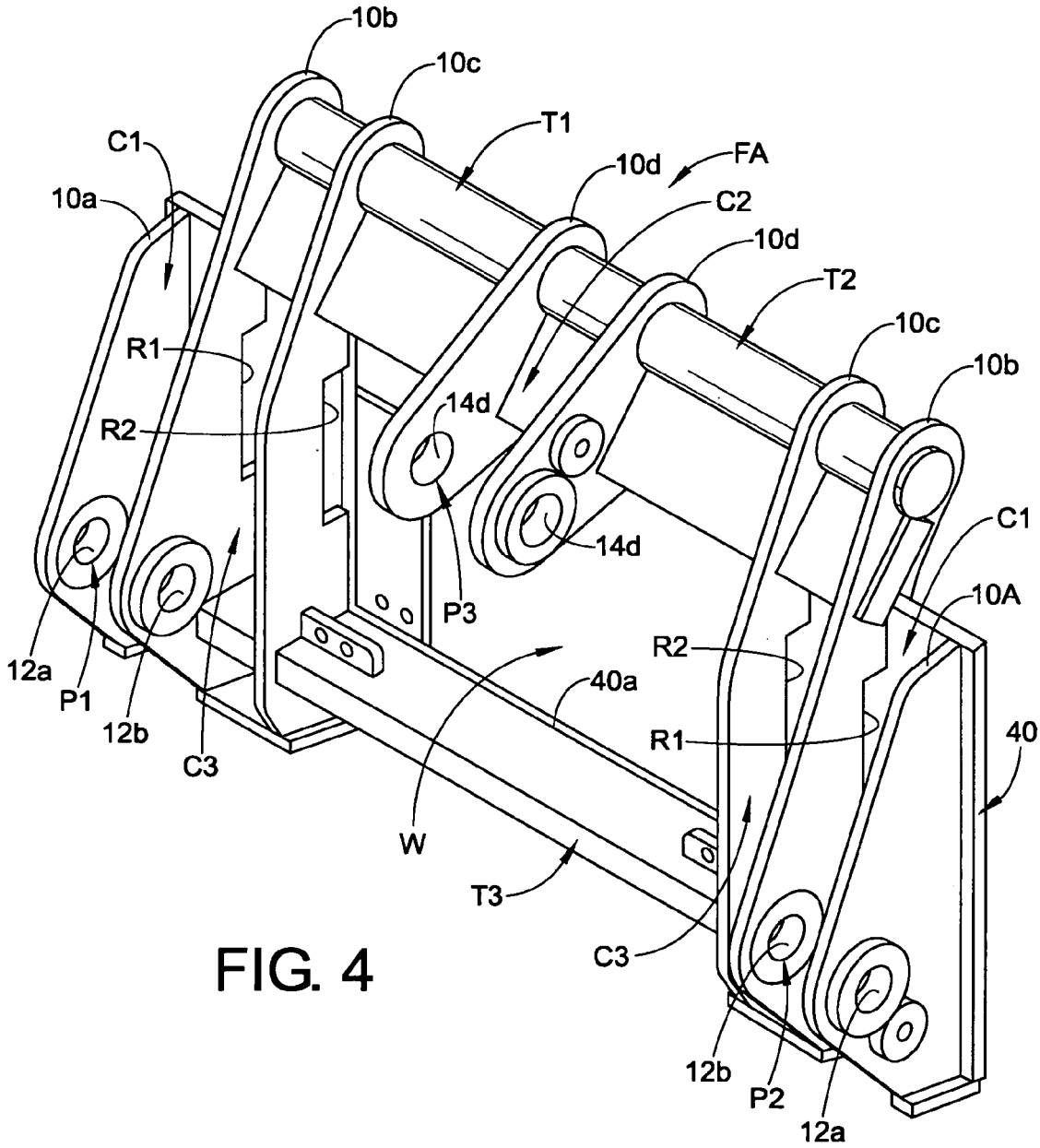
FIG. 4 is a rear isometric view of a frame of the male coupler portion shown in FIGS. 1–3, with the lock assemblies not shown)

As shown in FIG. 4, the ribs 10*b* of each coupler half A1,A2 define slots R1 and the ribs 10*c* define slots R2 that are aligned with the slots R1. As shown in FIG. 3, the lock wedges LW1,LW2 are each located partially in a lock channel C3 of respective coupler halves A1,A2 and are slidably held in an aligned pair of slots R1,R2, with the wedge portions 60*a*,60*b* located on opposite side of the plate openings 42*a*,42*b* and with the sloped face 66 of the wedge 60 oriented rearwardly away from the front plate 40 (see FIG. 1).

The lock assemblies L1,L2 comprise actuators for independently moving the lock wedges LW1,LW2 slidably parallel to the ribs 10*b*,10*c* and parallel to the face place 40 between locked and unlocked positions (as shown the lock wedges LW1,LW2 are slidably abutted with the plate 40). In a preferred embodiment, each lock assembly L1,L2 comprises a hydraulic cylinder HC (FIG. 3) including a rod that is operably coupled to the shaft 64 of the corresponding lock wedge LW1,LW2. The cylinders HC are supported in the cross-bar T3, and each cylinder is protected by a shield plate 48 (FIGS. 2,3) welded to the face plate 40. In an alternative embodiment, one single actuator is operably coupled through a linkage or other means to both lock wedges LW1,LW2 to move same, but use of two actuators is preferred to allow for independent movement of lock wedges LW1,LW2.

Figure 7B:
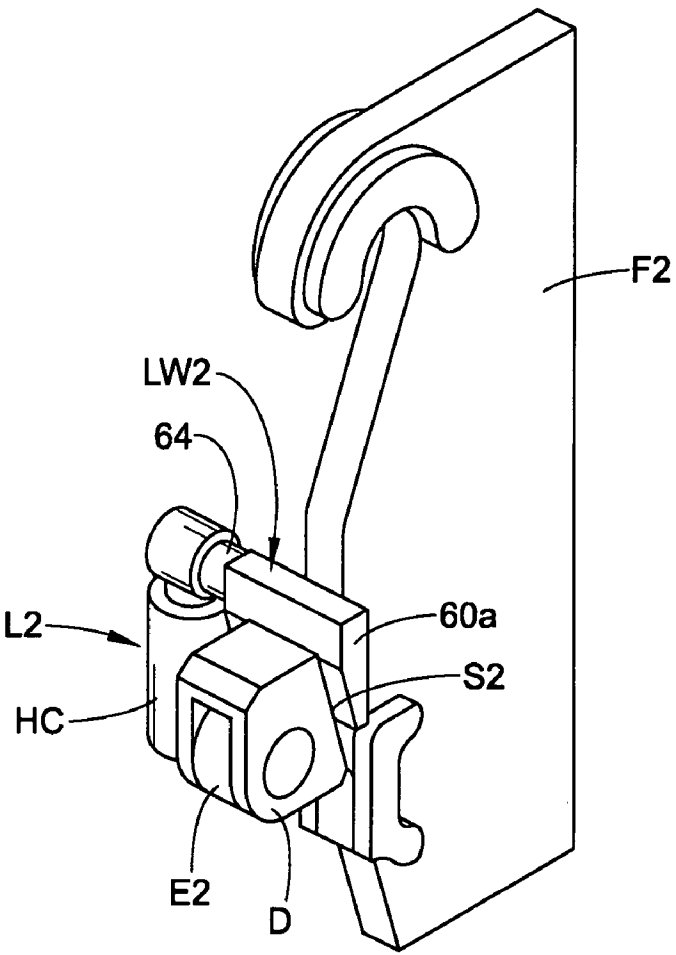
FIGS. 7A and 7B are diagrammatic illustrations that shown a female rib formed in accordance with the present invention and its selective engagement by a lock wedge member that forms a part of the male coupler portion shown in FIGS. 1–3.
Figure 7A:
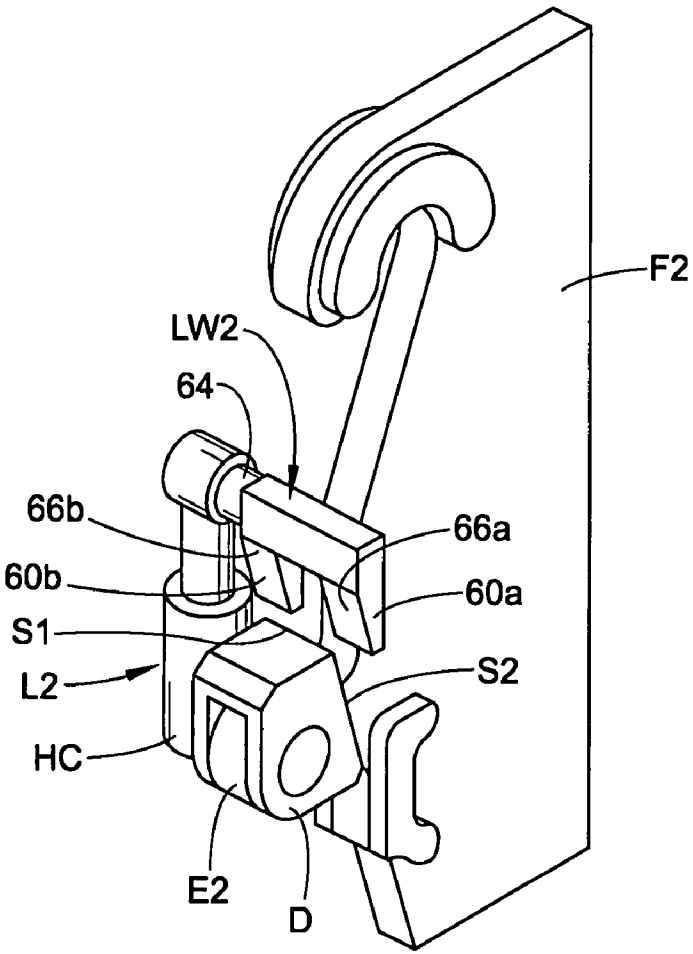

FIGS. 7A and 7B illustrate the lock assembly L2 and use of same to engage a female rib F2 of a female coupler portion B. FIG. 7A shows the cylinder HC actuated to position the lock wedge LW2 in the unlocked position, where the lock wedge LW2 is spaced away and disengaged from the ear E2 of the female rib F2. FIG. 7B shows the cylinder HC actuated to position the lock wedge LW2 in the locked position, so that the ear E2 is received in the gap 62 of the wedge 60, with the wedge portion 60*a* engaging and abutting the shoulder S2, and the wedge portion 60*b* engaging and abutting the shoulder S1.

Figure 8A:
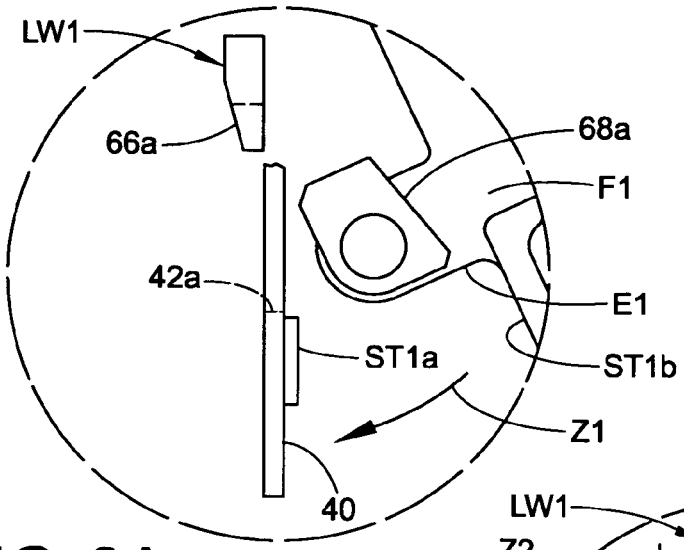
FIGS. 8A–8C are diagrammatic illustrations that show sequential engagement of a female rib by a male coupler portion in accordance with the present invention.
Figure 8B:
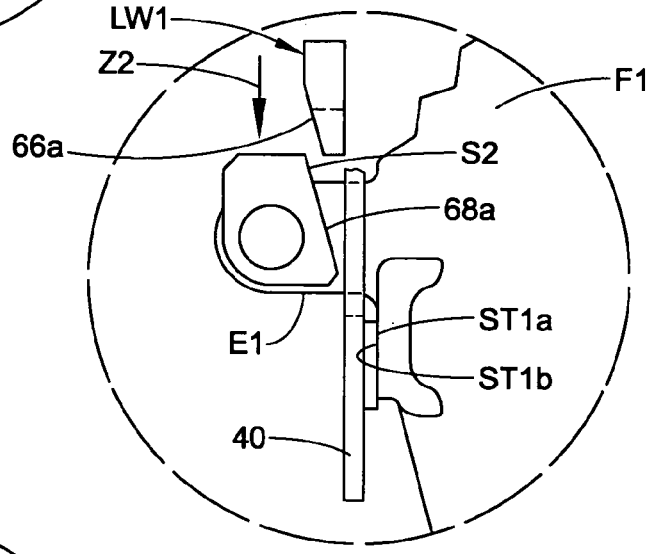
Figure 8C:
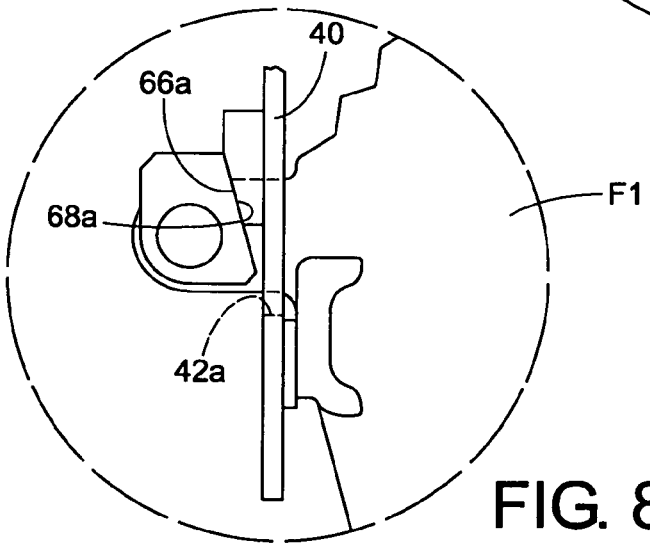

With the foregoing in mind, operation of the coupling system A,B is further described with reference to FIGS. 8A–8C. FIG. 8A shows a female rib F1 of a female coupler portion B partially operatively engaged by the male coupler portion A so that the ear E1 is able to move on an arc Z1 about the mount M1 toward the face plate 40. FIG. 8B shows full mating of the rib F1 with the male coupler portion A so that the ear E1 extends through opening 42*a* of face plate 40. The lock wedge LW1 is then moved from the unlocked position shown in FIG. 8B (where unobstructed movement of ear E1 into and out of opening 42*a* is allowed) to the locked position shown in FIG. 8C as indicated by the arrow Z2. When the lock wedge LW1 is moved to the locked position, it engages the shoulders S1,S2 of ear E1 as shown in FIG. 8C and prevents the ear E1 from being withdrawn from the opening 42*a* owing to the fact that the wedge LW1 is trapped between the shoulders S1,S2 and the plate 40. More particularly, the tapered surfaces 66*a*,66*b* of wedge LW1 engage mating tapered surfaces 68*a*,68*b* (FIG. 6C) of shoulders S1,S2 so that when the wedge LW1 moves from the unlocked to the locked position, the wedge LW1 pulls the female rib F1 into hard and secure contact with the male coupler portion A as shown in FIG. 8C. Use of lock wedge LW1 as described ensures that a tight fit between the male and female coupler components A,B can be obtained even after significant wear, i.e., further movement of the wedge LW1,LW2 away from its unlocked position into the locked position will result in further sliding engagement between the mating sets of tapered surfaces 66*a*,68*a* and 66*b*,68*b* in order to draw the female rib F1 into hard contact with the male coupler portion A, to a position where stop ST1*a* of male coupler portion A is abutted with stop ST1*b* of rib. The lock wedge LW2 and lock assembly L2 operate in a corresponding fashion relative to the shoulders S1,S2 of ear E2 when the ear E2 extends through the opening 42*b*. The ears E1,E2 need only define one shoulder S1,S2 to be engaged by lock wedge LW1,LW2 to capture the female ribs F1,F2 to the male coupler portion A.

The hydraulic cylinders HC are configured so that the force available to move the lock wedges LW1,LW2 from the unlocked position to the locked position is significantly less than the force available to move the lock wedges LW1,LW2 from the locked position to the unlocked position. This prevents an "over-wedging" condition, where one or both of the lock wedges LW1,LW2 becomes immovably seized between the shoulders S1,S2 of ear E1,E2 and the front plate 40. In one example, the hydraulic cylinders are configured so that the force available to move the wedges LW1,LW2 from the locked position to the unlocked position is more than twice the force available to move the wedges LW1,LW2 from the unlocked to the locked position.

Alternative Embodiment

Figure 11A:
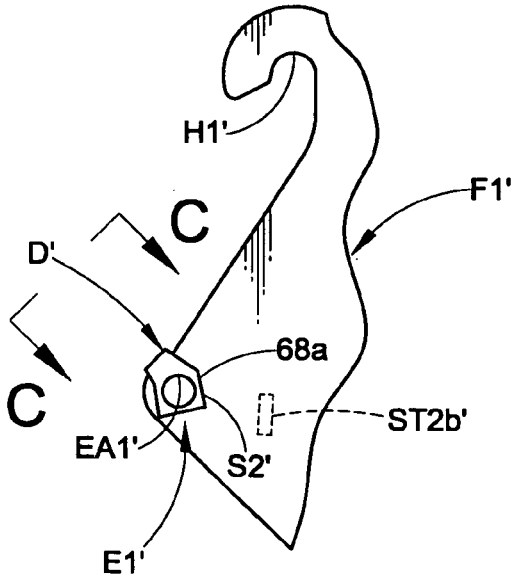
FIGS. 11A and 11B are partial side views of first and second female ribs that together are used to define an alternative female coupler portion in accordance with the present invention.
Figure 11B:
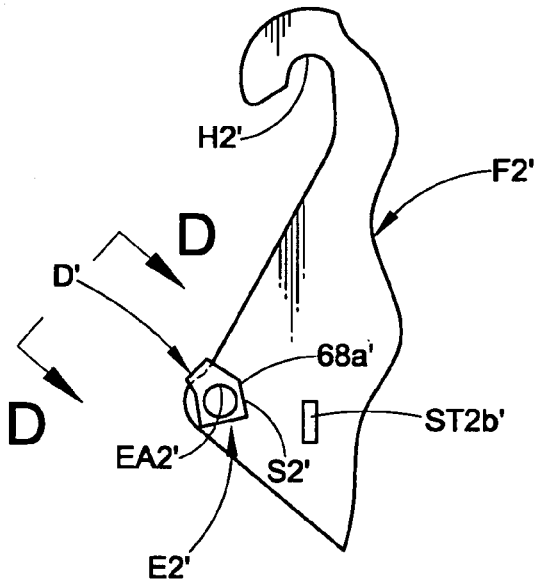
Figure 11C:
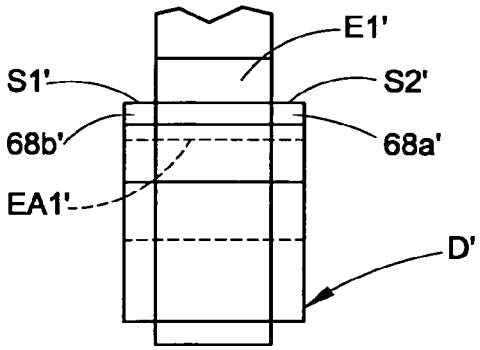
FIGS. 11C and 11D are views as taken along lines C—C and D—D of FIGS. 11A and 11B, respectively.
Figure 11D:
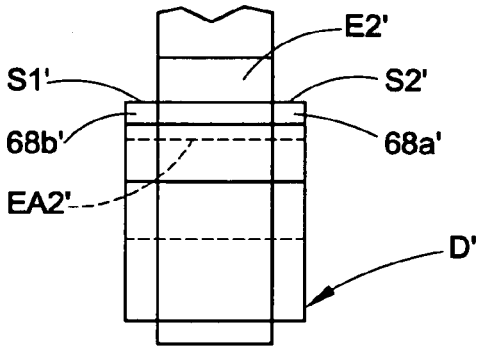

The female ribs F1,F2 described above can be provided in more than one different overall shape. FIGS. 11A and 11B partially show first and second ribs F1',F2' that define a second rib shape. The ribs F1',F2' have the same general structure and function as the ribs F1,F2, respectively, but have a different shape as shown so as not to be matable with the male coupler portion A. It has been deemed desirable to provide a male coupler portion that can mate interchangeably with a female coupler portion B defined by a pair of ribs F1,F2 as shown in FIG. 6B above or a female coupler portion defined by a pair of ribs F1',F2' arranged in the same manner as the ribs F1,F2 of FIG. 6B.

According to the alternative embodiment disclosed hereinbelow, a hybrid male coupler portion A' for a front-end loader is provided and is operable to mate selectively and interchangeably with a female coupler portion comprising a pair of parallel spaced-apart ribs F1,F2 or a pair of parallel spaced-apart ribs F1',F2' as required. The ribs F1',F2' are constructed from conventional ribs having the same shape by adding at least one and preferably both shoulders S1',S2' thereto, e.g., via adapter D' in the same manner as described above for constructing ribs F1,F2 from a conventional rib F or by an alternative method. As such, like components relative to the ribs F1,F2 are identified with like reference characters including a primed (') suffix. Notably, the ribs F1',F2' comprise stops ST2*b*' located differently as compared to stops ST1*b* of ribs F1,F2.

The hybrid male coupler portion is shown generally at A' in FIGS. 12–15. Except as otherwise shown and/or described herein, the male coupler portion A' is structured and functions identically relative to the coupler A. Accordingly, like components of the coupler A' relative to the coupler A have been identified with like reference characters including a primed (') suffix.

Figure 14:
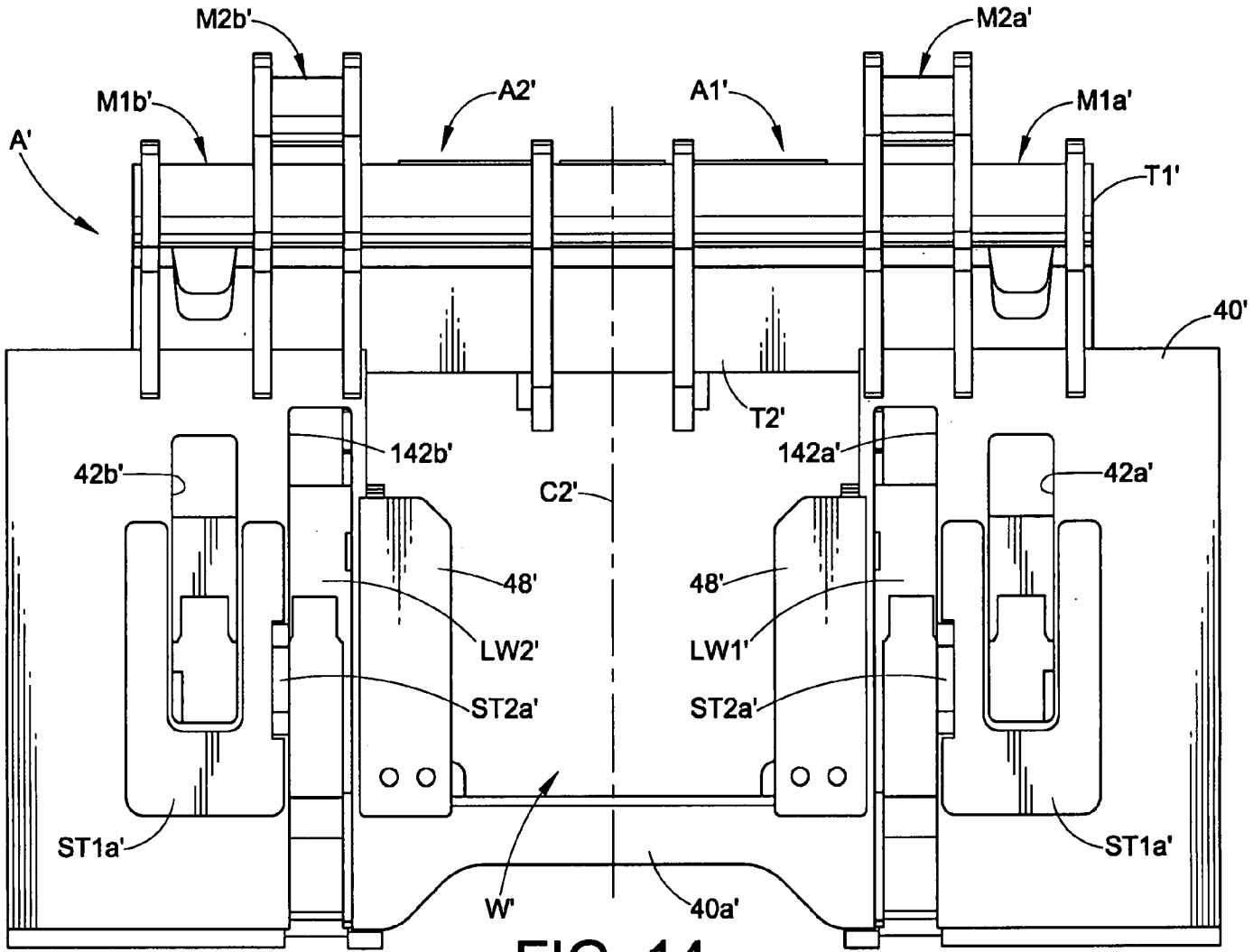
FIG. 14 is a front elevational view of the male coupler portion shown in FIG. 12.
Figure 15:
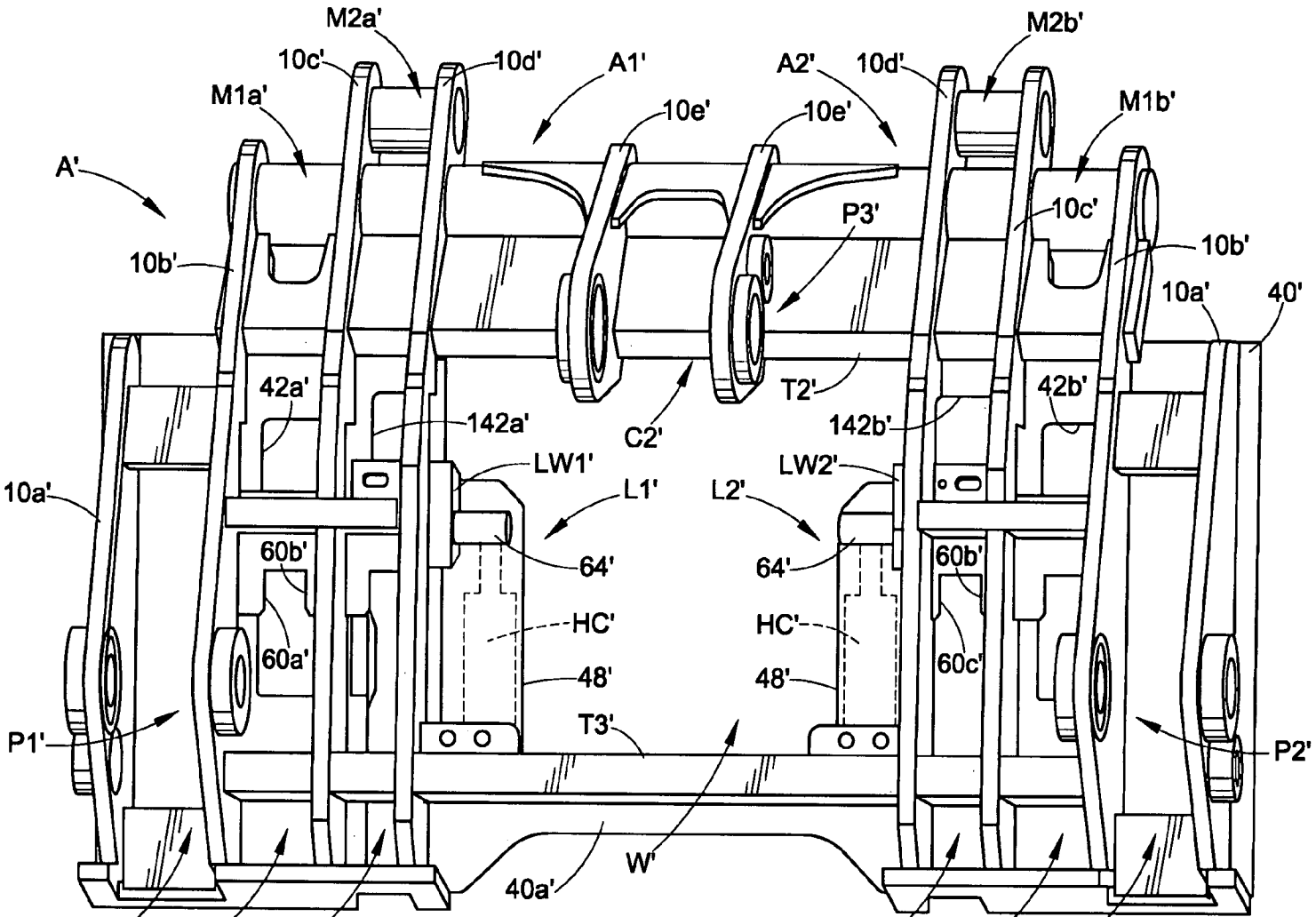
FIG. 15 is a rear isometric view of the male coupler portion shown in FIG. 12.

The male coupler portion A' comprises a frame FA' and first and second lock assemblies L1',L2' (FIG. 15). The male coupler portion A' is defined by first and second lateral halves A1',A2' that are preferably formed symmetrically or nearly so about a centerline CL'. For ease of understanding the development, the male coupler portion A' is described herein as having a front AF' (FIG. 14) that is oriented toward and engages an associated female coupler portion (such as that shown at B in FIG. 6B), and a rear region AR' (FIG. 15) that is oriented toward and connected via pin-on connection to an associated loader machine (not shown).

The frame FA' comprises a plurality of parallel, spaced-apart vertical ribs defined from steel plate or the like. In the illustrated embodiment, each half A1',A2' comprises five parallel vertical ribs 10*a*',10*b*',10*c*',10*d*',10*e*'. The ribs 10*a*', 10*b*' of each coupler half A1',A2' cooperate to define therebetween an arm-receiving channel C1' adapted to receive the distal end of the arm of an associated loader machine. The ribs 10*a*',10*b*' define respective apertures 12*a*',12*b*' that are aligned so as to define an arm pin-on points P1' (for the coupler half A1') and P2' (for the coupler half A2'). As such, the ribs 10*a*',10*b*' of each coupler half A1',A2' are adapted for pin-on pivotable connection to associated first and second arms of a front-end loader or other machine at locations P1',P2' by means of the aligned apertures 12*a*',12*b*'. This allows the male coupler portion A' to pivot relative to the loader arms about the pin-on points P1',P2' between dump and roll-back positions known in the art.

Likewise, the coupler portion A' comprises at least one and possibly multiple locations for pin-on connection to a tilt-link and/or first and second tilt-cylinders. In the illustrated example, the associated tilt link or other control member of the associated front-end loader or other machine is adapted for pin-on pivotable connection to the male coupler portion A' between the central ribs 10*e*' of each coupler half A1',A2' at a location P3' by means of aligned apertures 14*e*' defined in the central ribs 10*e*'. More particularly, the two central ribs 10*e*' cooperate to define therebetween a link channel C2' adapted to receive an associated tilt link, cylinder rod-eye or other member that controls the angular position of the male coupler portion A' relative to the loader arms connected at points P1',P2'. The tilt link or other control member is pivotally secured to the male coupler portion A' via pin-on connection at the point P3' defined by the aligned apertures 14*e*' of ribs 10*e*'. Bosses and pin-retainers are provided at all pin-on locations P1',P2',P3' to ensure proper pin fit and retention and for added strength as is generally known in the art.

As is readily apparent in FIG. 15, the ribs 10*b*',10*c*' of each coupler half A1',A2' define therebetween a first lock channel C3'. The ribs 10*c*',10*d*' of each coupler half A1',A2' define therebetween a second lock channel C4'. As described in further detail below, the first and second coupler halves A1',A2' include respective first and second lock assemblies L1',L2'. The lock assemblies L1',L2' include respective first and second locking wedges LW1',LW2'. At least a portion of lock wedge LW1' is slidably located in both lock channels C3',C4' of the coupler half A1' for sliding movement parallel to face plate 40'; at least a portion of lock wedge LW2' is slidably located in both lock channel C3',C4' of the coupler half A2' for sliding movement parallel to a face plate 40' of the coupler portion A'. The lock wedges LW1'LW2' can be defined as one-piece members or can be constructed from multiple components and are shown separately in FIGS. 16A,16B,17A,17B The ribs 10*b*',10*c*',10*d*',10*e*' of each coupler half A1',A2' are fixedly secured to a first, upper steel cross bar or member T1' by insertion of the member T1' through aligned apertures defined in the ribs 10*b*',10*c*',10*d*',10*e*' of each half A1',A2' and welding at each juncture of the member T1' with the ribs. In a similar manner, a second upper cross-bar T2' is connected to the ribs 10*b*',10*c*',10*d*',10*e*' of each coupler half A1',A2' by passage through aligned openings in all of these ribs and welding at the various interfaces between the cross-bar T2' and each rib. A lower cross-bar T3' is spaced from the second upper cross-bar T2'. The lower cross-bar T3' extends through openings defined in the ribs 10*c*',10*d*' of each half A1',A2' and is welded to these ribs and is also preferably welded to the ribs 10*b*' of each half A1',A2'. Various gussets G' are provided for added strength (see e.g., FIG. 12).

As described above in relation to FIG. 6B, a female portion B of the coupling system selectively and releasably mates with the male portion A'. The female portion B comprises first and second vertical, parallel, spaced-apart female ribs F1,F2 connected to a bucket or other attachment AT. The ribs F1,F2 can alternatively be defined as ribs F1',F2' (FIGS. 11A,11B). As such, mating of the male portion A' with the female portion results in operative connection of the attachment AT to the loader arms and control linkage of the associated loader to which the male portion A' is connected via pin-on connections as described above.

Referring again to FIGS. 12–15, the male coupler portion A' comprises a pair of first hook engaging mounts M1*a*', M1*b*' (one per half A1',A2') that engage and are received into hooks H1,H2 of respective female ribs F1,F2 when the ribs are connected to an attachment to define a female coupler portion B as shown in FIG. 6B. More particularly, in the illustrated embodiment, the mounts M1*a*',M1*b*' are defined as part of or connected to the first upper cross-member T1' (which is round in the illustrated example) between the ribs 10*b*',10*c*' of each half A1',A2'. Alternatively, the mounts M1*a*',M1*b*' are provided separate from the upper cross-member T1'. Preferably, the mounts M1*a*',M1*b*' and the hooks H1,H2 define or otherwise comprise mating cylindrical surfaces so that the ribs F1,F2 pivot about the mounts M1*a*',M1*b*' as described further below for coupling/decoupling.

The male coupler portion A' further comprises a pair of second hook engaging mounts M2*a*',M2*b*' (one per half A1',A2') that engage and are received into hooks H1',H2' of respective female ribs F1',F2' (FIGS. 11A,11B) when these ribs are connected to an attachment AT in the general arrangement shown in FIG. 6B to define an alternative female coupler portion. More particularly, in the illustrated embodiment, the mounts M2*a*',M2*b*' are defined by members that extend between the ribs 10*c*',10*d*' of each half A1',A2' of the male coupler portion A' at a point above first upper cross-member T1'. Preferably, the mounts M2*a*',M2*b*' are defined by round stock or otherwise to comprise a cylindrical surface so that the hooks H1',H2' of ribs F1',F2' pivot about the mounts M2*a*',M2*b*' for coupling/decoupling.

A generally U-shaped steel face plate 40', preferably but not necessarily one-piece, extends across the front AF' of the coupler A' as best seen in FIG. 14. The steel face plate 40' is welded to ribs 10*a*',10*b*',10*c*',10*d*' of both coupler halves A1',A2'. It is most preferred that, for added visibility, the plate 40' be U-shaped as shown and comprise a narrow central web region 40*a*' that extends between coupler halves A1',A2'. Thus, it can be seen that a large, open and unobstructed window W' for high visibility is defined and framed between the ribs 10*d*' of each half, the narrow portion 40*a*' of plate 40' and the second upper cross-bar T2'.

With continuing reference to FIG. 14, the face plate 40' defines a first set of openings 42*a*',42*b*' (FIGS. 14,15) through which the ears E1,E2 of ribs F1,F2 project when the male coupler portion A' is mated to the female coupler portion B including a set of ribs F1,F2, i.e., when the mounts M1*a*',M1*b*' of male coupler portion A' are seated in the hooks H1,H2 of ribs F1,F2, respectively. The opening 42*a*' is aligned with the lock channel C3' and mount M1*a*' of the coupler half A1', and the opening 42*b*' is aligned with the lock channel C3' and mount M1*b*' of the coupler half A2'. As such, when the female coupler portion B comprising a pair of ribs F1,F2 is operably mated with the male coupler portion A', the ear E1 of a first rib F1 projects through opening 42*a*' into the lock channel C3' of coupler half A1' for engagement of shoulder S1,S2 of ear E1 by the lock wedge LW1'; and the ear E2 of a second rib F2 projects through opening 42*b*' into lock channel C3' of coupler half A2' for engagement of shoulders S1,S2 of ear E2 by the lock wedge LW2'.

The plate 40' also defines a second set of openings 142*a*',142*b*' (FIGS. 14,15) through which the ears E1',E2' of ribs F1',F2' project when the male coupler portion A' is mated to a female coupler portion comprising a pair of ribs F1',F2', i.e., when the mounts M2*a*',M2*b*' of male coupler portion A' are seated in the hooks H1',H2' of ribs F1',F2', respectively. The opening 142*a*' is aligned with the lock channel C4' and mount M2*a*' of the coupler half A1' and the opening 142*b*' is aligned with the lock channel C4' and the mount M2*b*' of the coupler half A2'. As such, when the female coupler portion comprising a pair of alternatively shaped ribs F1',F2' is operably mated with the male coupler portion A', the ear E1' of a first rib F1' projects through opening 142*a*' into the lock channel C4' of coupler half A1' for engagement of shoulders S1',S2' of ear E1' by the lock wedge LW1'; and the ear E2' of a second rib F2' projects through opening 142*b*' into lock channel C4' of coupler half A2' for engagement of shoulders S1',S2' of ear E2' by the lock wedge LW2'. The openings 42*a*',42*b*',142*a*',142*b*' are provided by any space or void that accommodates the ears E1,E2,E1',E2' and need not be shaped as shown. The openings 42*a*',142*a*' can be separate or merged together, and the openings 42*b*',142*b*' can be separate or merged together, i.e., they can be defined as one large opening that comprises both openings.

Figure 16A:
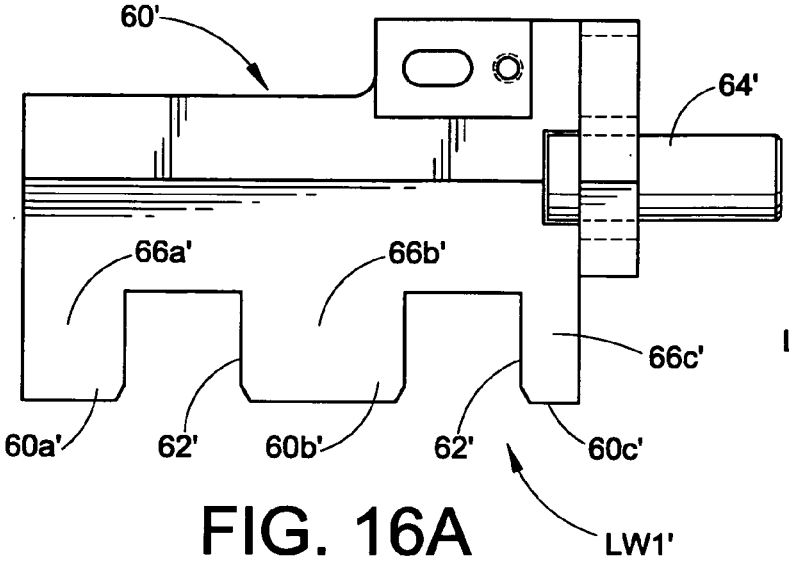
FIGS. 16A and 16B are rear and side elevational views of a first locking wedge portion of the coupler shown in FIG. 12; and, FIGS. 17A and 17B are rear and side elevational views of a second locking wedge portion of the coupler shown in FIG. 12.
Figure 16B:
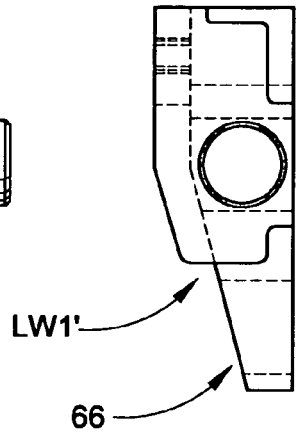
Figure 17A:
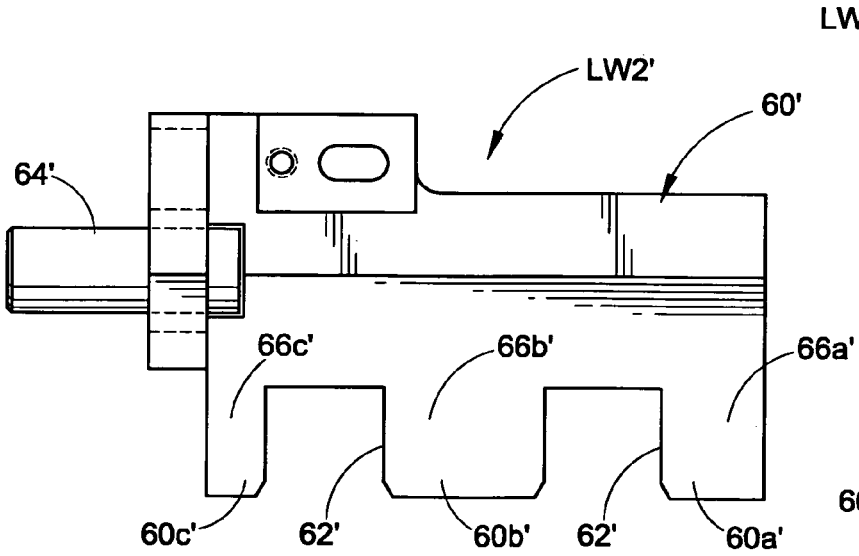
Figure 17B:
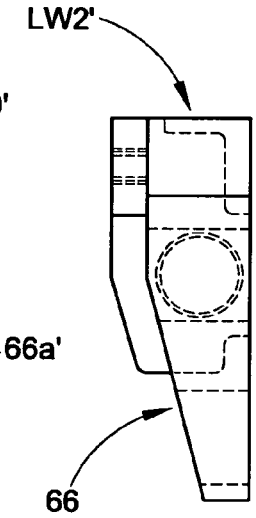

FIGS. 16A and 16B show the lock wedge LW1' and FIGS. 17A,17B show the lock wedge LW2'. The lock wedges LW1',LW2' are preferably mirror images of each other. The lock wedges LW1,LW2 each comprises a wedge member 60' having first, second and third wedge portions 60*a*',60*b*',60*c*' separated by a gaps 62'. A shaft 64' projects outwardly from the wedge member and extends laterally inward toward centerline CL of the coupler A'. The wedge member defines a sloped or tapered wedge face 66 comprising first, second and third tapered portions 66*a*',66*b*',66*c*' defined by the wedge portions 60*a*',60*b*',60*c*', respectively.

Figure 12:
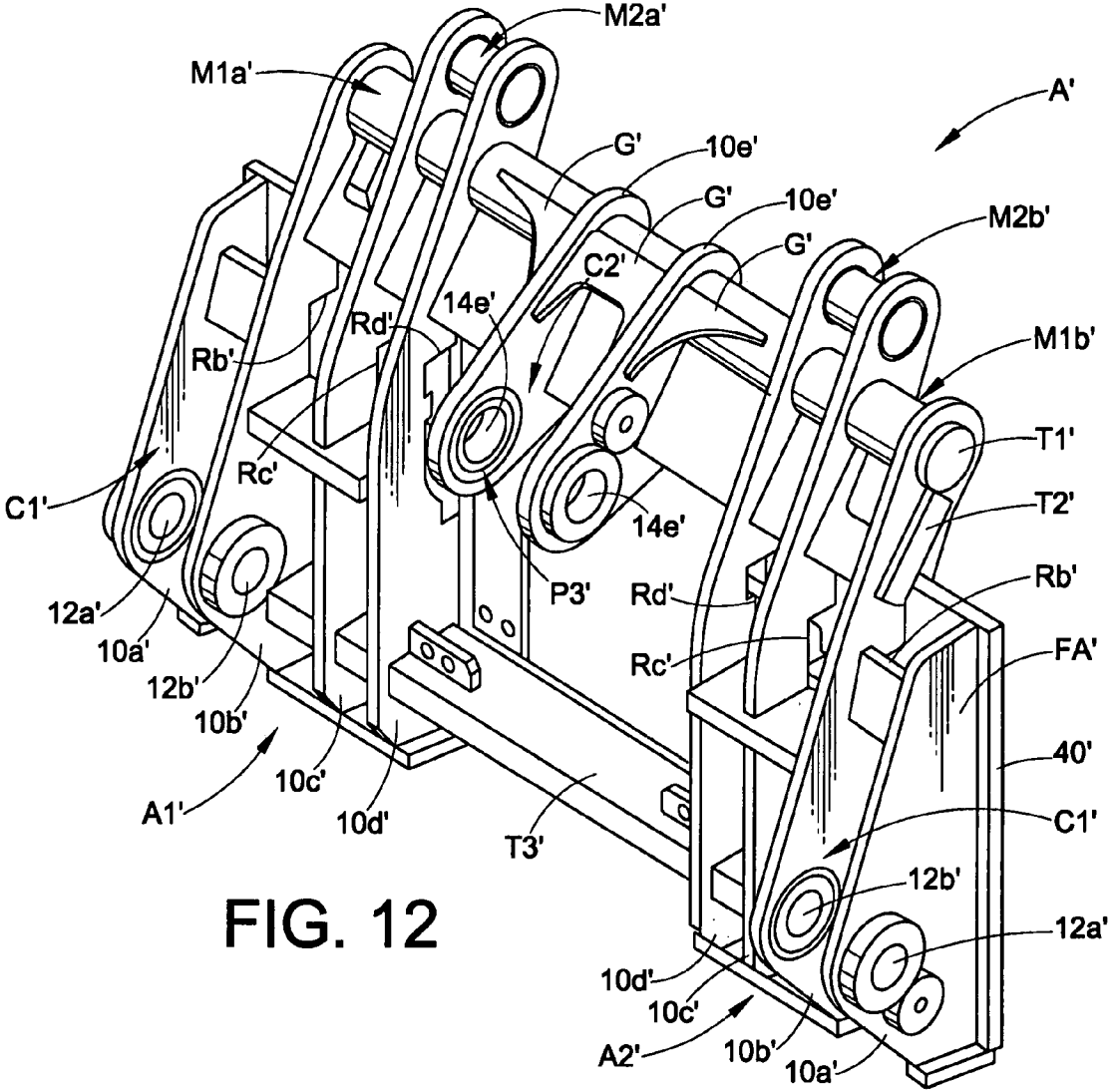
FIG. 12 is an isometric view of an alternative embodiment of a male coupler portion formed in accordance with the present invention.

As shown in FIGS. 12 and 15, the ribs 10*b*',10*c*',10*d*' of each coupler half A1',A2' define respective aligned slots Rb',Rc',Rd'. The lock wedge LW1' is slidably located in slots Rb',Rc',Rd' of coupler half A1' with the shaft 64' extending laterally inward from rib 10*d*' and adapted for sliding movement toward and away from member T3' between locked and unlocked positions; the lock wedge LW2' is slidably located in slots Rb',Rc',Rd' of coupler half A2' with the shaft 64' extending laterally inward from rib 10*d*' and adapted for sliding movement toward and away from member T3' between locked and unlocked positions. For each lock wedge LW1',LW2', the wedge portions 60*a*',60*b*' are located on opposite lateral sides of the relevant plate openings 42*a*',42*b*' and the wedge portions 60*b*',60*c*' are located on opposite sides of the relevant plate openings 142*a*',142*b*'. The sloped face 66 of the wedges LW1',LW2' are oriented rearwardly away from the face plate 40'. In the unlocked position, the locking wedge LW1' does not inhibit movement of ears E1, E1', into and out of openings 42*a*',142*a*'. Likewise, in the unlocked position, the locking wedge LW2' does not inhibit movement of ears E2, E2', into and out of openings 42*b*',142*b*'.

The lock assemblies L1',L2' further comprise actuators for independently moving the lock wedges LW1',LW2' slidably parallel to the ribs 10*b*',10*c*',10*d*' between locked and unlocked positions. In a preferred embodiment, each lock assembly L1',L2' comprises a hydraulic actuator such as a hydraulic cylinder HC' (shown in phantom lines in FIG. 15) including a rod that is operably coupled to the shaft 64' of the corresponding lock wedge LW1',LW2'. The cylinders HC' are supported on lower cross-bar T3'. Each cylinder HC' is protected by a shield plate 48' welded to the face plate 40'. A single actuator HC' can be used to control movement of both lock wedges LW1',LW2', but use of two independently operable actuators is deemed preferred to allow for independent movement of the lock wedges LW1',LW2' which provides an arrangement that is less sensitive to misalignment.

The lock assemblies L1',L2' operate in the same general fashion as the lock assemblies L1,L2 as shown in FIGS. 7A and 7B and described above. When ribs F1,F2 are mated to the male coupler portion A', the ears E1,E2 thereof extend through plate openings 42*a*',42*b*' into lock channels C3'. The lock wedges LW1',LW2' are then moved (downward) to their locked positions so that the ears E1,E2 are received in the gaps 62 between wedge portions 60*a*',60*b*' of respective locking wedges LW1',LW2' and so that wedge portions 60*a*',60*b*' engage shoulders S1,S2 to prevent ears E1,E2 from being removed from openings 42*a*,42*b*. Similarly, when ribs F1',F2' are mated to the male coupler portion A', the ears E1',E2' thereof extend through plate openings 142*a*',142*b*' into lock channels C4'. The lock wedges LW1', LW2' are then moved (downward) to their locked positions so that the ears E1',E2' are received in the gaps 62 between wedge portions 60*b*',60*c*' of respective lock wedges LW1', LW2' and so that wedge portions 60*b*',60*c*' engage shoulders S1',S2' to prevent ears E1',E2' from being removed from openings 142*a*',142*b*'. Use of lock wedges LW1',LW2' as described ensures that a tight fit between the male and female coupler components can be obtained even after significant wear, i.e., further movement of the wedges LW1', LW2' away from their unlocked position into the locked position will draw the female ribs F1,F2; F1',F2' into hard contact with the male coupler portion A'. The lock wedges LW1',LW2' preferably move parallel to vertical ribs 10*a*'–10*e*' and parallel to face plate 40' in sliding abutment with plate 40'.

The hydraulic cylinders HC' are preferably configured so that the force available to move the lock wedges LW1',LW2' from the unlocked position to the locked position is significantly less than the force available to move the lock wedges LW1',LW2' from the locked position to the unlocked position. This prevents an over-wedging condition, where one or both of the lock wedges LW1',LW2' becomes immovably seized between the shoulders S1,S2;S1',S2' and the front plate 40'.

Figure 13:
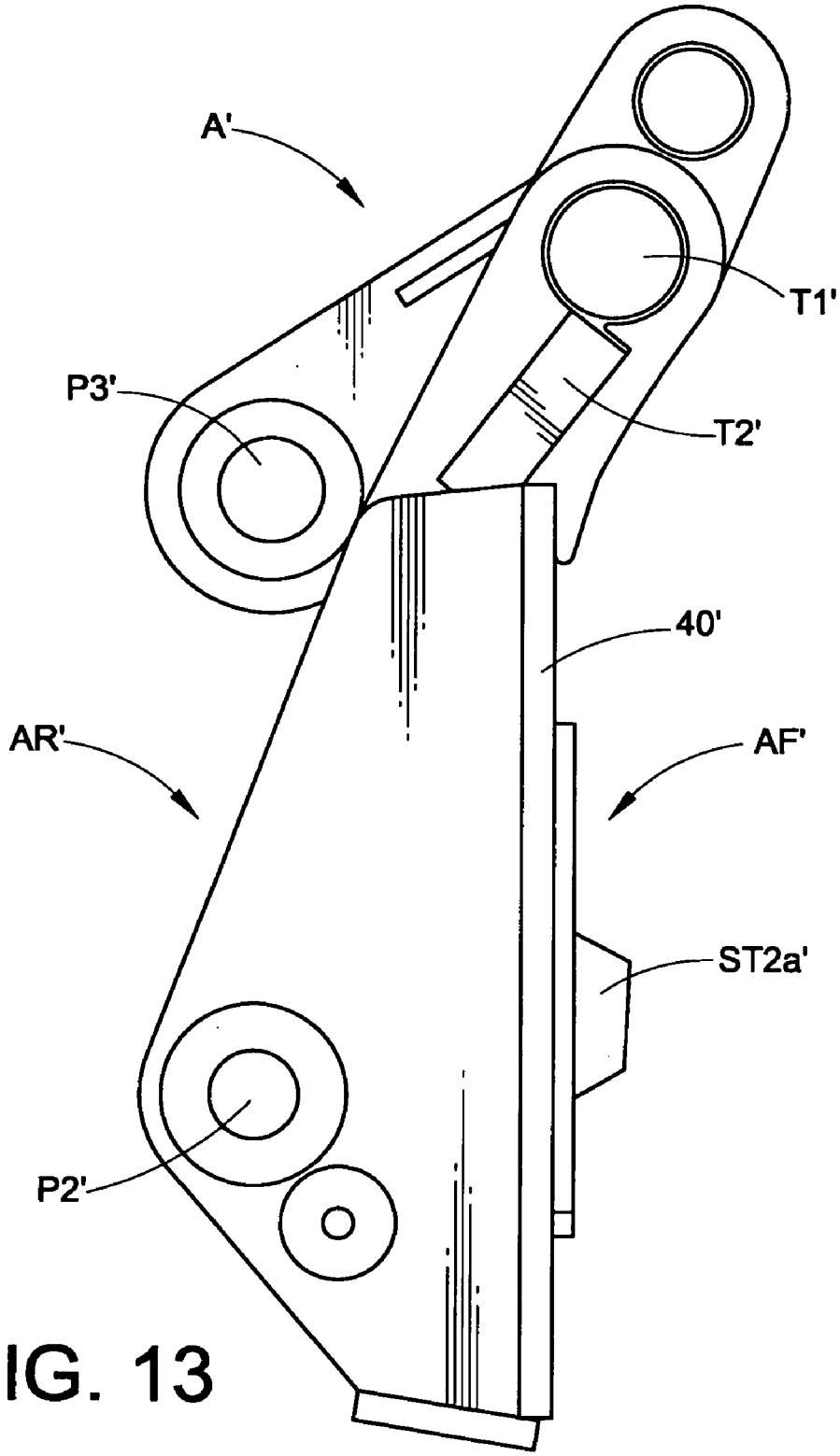
FIG. 13 is a right side elevational view of the male coupler portion shown in FIG. 12.

As shown in FIGS. 13 and 14, each half A1',A2' of male coupler portion A' further comprises stops ST2*a*' located adjacent openings 142*a*',142*b*'. These stops abut stops ST2*b*' of ribs F1',F2' when the ribs are fully mated with and captured to the coupler portion A'. The coupler portion A' also comprises stops ST1*a*' adjacent opening 42*a*' and opening 42*b*' for abutting stops ST1*b* of ribs F1,F2 as described above.

In the illustrated examples, the ribs F1,F2 are JRB-style ribs as are known in the art in that the ribs are conformed and arranged relative to each other so as to define a female coupler portion that mates with a conventional male coupler portion available commercially from JRB COMPANY, INC., Akron, Ohio, U.S.A., and the ribs F1',F2' are CAT-style ribs in that the ribs are conformed and arranged relative to each other so as to define a female coupler portion that mates with a conventional male coupler portion available commercially from CATERPILLAR INC., Peoria, Ill., U.S.A. Of course, the ribs F1,F2 and F1',F2' are different from conventional JRB and/or CAT ribs in that they include or define one or more shoulders S1,S2 and S1',S2', respectively, as described in detail above, so that they can also mate with the male coupler portion A'.

The invention has been described with reference to a preferred embodiment. Modifications and alterations will occur to those of ordinary skill in the art to which the invention pertains upon reading this specification. It is intended that the claims be construed literally and/or according to the doctrine of equivalents to the fullest extent legally possible so as to encompass all such modifications and alterations.

The invention claimed is:

1. A male coupler portion comprising:

a frame having a front region and a rear region, said rear region comprising first and second pin-on locations for being pivotally connected to respective first and second associated machine arms, and at least one pin-on location for an associated tilt control member;

a first pair of laterally spaced apart hook engaging mounts adapted to be received respectively by associated first and second hooks of an associated female coupler portion;

a first pair of openings adapted to receive respective associated first and second projecting ears of the associated female coupler portion;

first and second lock members slidably connected to said frame and each movable between an unlocked position and a locked position, wherein said first lock member at least partially obstructs one of said first pair of openings when moved to the locked position, and wherein said second lock member at least partially obstructs the other of said first pair of openings when moved to the locked position, each of said first and second lock members comprising a wedge shaped portion comprising two wedge sections separated by a gap wherein said gap of the first lock member is adapted to receive the associated first projecting ear when the first lock member is in the locked position, and wherein said gap of the second lock member is adapted to receive the associated second projecting ear when the second lock member is in the locked position; and, at least one actuator connected to the frame for moving the first and second lock members between the unlocked and locked positions.

2. The male coupler portion as set forth in claim 1, further comprising a face plate in which said first pair of openings are defined, wherein said first and second lock members move parallel to said face plate.

3. The male coupler portion as set forth in claim 1, wherein said at least one actuator comprises a hydraulic cylinder.

4. The male coupler portion as set forth in claim 3, wherein said at least one actuator comprises first and second hydraulic cylinders operably and respectively connected to said first and second lock members.

5. A male coupler portion comprising:

a frame having a front region and a rear region, said rear region comprising first and second pin-on locations for being pivotally connected to respective first and second associated machine arms, and at least one pin-on location for an associated tilt control member;

a first pair of laterally spaced apart hook engaging mounts adapted to be received respectively by associated first and second hooks of an associated female coupler portion;

a first pair of openings adapted to receive respective associated first and second projecting ears of the associated female coupler portion;

first and second lock members slidably connected to said frame and each movable between an unlocked position and a locked position, wherein said first lock member at least partially obstructs one of said first pair of openings when moved to the locked position, and wherein said second lock member at least partially obstructs the other of said first pair of openings when moved to the locked position, each of said first and second lock members comprising first and second sections separated by a gap; and, at least one actuator connected to the frame for moving the first and second lock members between the unlocked and locked positions, wherein said frame comprises first and second spaced-apart cross-bars and a plurality of spaced-apart ribs that extend perpendicularly between said first and second cross-bars, and wherein said first and second lock members move parallel to said plurality of ribs when moving between said unlocked and locked positions.

6. The male coupler portion as set forth in claim 4, wherein said frame comprises first and second spaced-apart cross-bars and a plurality of spaced-apart ribs that extend perpendicularly between said first and second cross-bars, and wherein said first and second lock members move parallel to said plurality of ribs when moving between said unlocked and locked positions.

7. The male coupler portion as set forth in claim 6, wherein said first and second hydraulic cylinders are supported on and secured to said second cross-bar.

8. The male coupler portion as set forth in claim 6, wherein said first pair of hook engaging mounts are defined by said first cross-bar.

9. The male coupler portion as set forth in claim 5, wherein a first pair of said ribs defines a first lock channel therebetween, and wherein a second pair of ribs defines a second lock channel therebetween, and wherein said first and second lock members are at least partially located in said first and second lock channels, respectively.

10. The male coupler portion as set forth in claim 9, wherein said pair of ribs defining said first lock channel define respective first slots that cooperate to slidably retain said first lock member, and wherein said pair of ribs defining said second lock channel define respective second slots that cooperate to slidably retain said second lock member.

11. The male coupler portion as set forth in claim 9, wherein one hook engaging mount of said first pair of hook engaging mounts is aligned with said first lock channel, and the other hook engaging mount of said first pair of hook engaging mounts is aligned with said second lock channel.

12. The male coupler portion as set forth in claim 11, wherein one opening of said first pair of openings opens into said first lock channel, and the other opening of said first pair of openings opens into said second lock channel.

13. The male coupler portion as set forth in claim 4, wherein said first and second hydraulic cylinders move said first and second lock members, respectively, with a first maximum force from said unlocked position to said locked position, and with a second maximum force from said locked position to said unlocked position, and wherein said second maximum force is greater than said first maximum force.

14. A male coupler portion comprising:

a frame having a front region and a rear region, said rear region comprising first and second pin-on locations for being pivotally connected to respective first and second associated machine arms, and at least one pin-on location for an associated tilt control member;

a first pair of laterally spaced apart hook engaging mounts adapted to be received respectively by associated first and second hooks of an associated first female coupler portion;

a first pair of openings adapted to receive respective associated first and second projecting ears of the associated first female coupler portion;

first and second lock members slidably connected to said frame and each movable between an unlocked position and a locked position, wherein said first lock member at least partially obstructs one of said first pair of openings when moved to the locked position, and wherein said second lock member at least partially obstructs the other of said first pair of openings when moved to the locked position;

at least one actuator connected to the frame for moving the first and second lock members between the unlocked and locked positions;

a second pair of laterally spaced apart hook engaging mounts adapted to be received respectively by associated first and second hooks of an associated second female coupler portion;

a second pair of openings adapted to receive respective first and second projecting ears of the associated second female coupler portion, wherein said first lock member at least partially obstructs one of said second pair of openings when moved to the locked position, and wherein said second lock member at least partially obstructs the other of said second pair of openings when moved to the locked position;

wherein said frame comprises first and second spaced-apart cross-bars and a plurality of spaced-apart ribs that extend perpendicularly between said first and second cross-bars, and wherein said first and second lock members move parallel to said plurality of ribs when moving between said unlocked and locked positions.

15. The male coupler portion as set forth in claim 14, said first pair of openings and said second pair of openings comprise four separate openings that are not merged with each other.

16. A male coupler portion comprising:

a frame having a front region and a rear region, said rear region comprising first and second pin-on locations for being pivotally connected to respective first and second associated machine arms, and at least one pin-on location for an associated tilt control member;

a first pair of laterally spaced apart hook engaging mounts adapted to be received respectively by associated first and second hooks of an associated female coupler portion;

a first pair of openings adapted to receive respective associated first and second projecting ears of the associated first female coupler portion;

first and second lock members slidably connected to said frame and each movable between an unlocked position and a locked position, wherein said first lock member at least partially obstructs one of said first pair of openings when moved to the locked position, and wherein said second lock member at least partially obstructs the other of said first pair of openings when moved to the locked position;

at least one actuator connected to the frame for moving the first and second lock members between the unlocked and locked positions, a second pair of laterally spaced apart hook engaging mounts adapted to be received respectively by associated first and second hooks of an associated second female coupler portion;

a second pair of openings adapted to receive respective first and second projecting ears of the associated second female coupler portion, wherein said first lock member at least partially obstructs one of said second pair of openings when moved to the locked position, and wherein said second lock member at least partially obstructs the other of said second pair of openings when moved to the locked position;

wherein said first and second lock members each comprise a wedge shaped portion comprising first, second, and third wedge sections, said first and second wedge sections separated by a first gap and said second and third wedge sections separated by a second gap wherein said first gap is adapted to receive one of the associated first and second projecting ears of the associated first female coupler portion when the first and second lock members are in the locked position; and, wherein said second gap is adapted to receive one of the associated first and second projecting ears of the associated second female coupler portion when the first and second lock members are in the locked position.

* * * * *